US008561580B2

(12) United States Patent
Kakehashi et al.

(10) Patent No.: US 8,561,580 B2
(45) Date of Patent: Oct. 22, 2013

(54) ENGINE COOLING DEVICE

(75) Inventors: Nobuharu Kakehashi, Toyoake (JP); Michio Nishikawa, Nagoya (JP); Mitsunobu Uchida, Okazaki (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 192 days.

(21) Appl. No.: 13/066,778

(22) Filed: Apr. 25, 2011

(65) Prior Publication Data

US 2011/0259287 A1 Oct. 27, 2011

(30) Foreign Application Priority Data

Apr. 27, 2010 (JP) ..... 2010-102080

(51) Int. Cl.

| | |
|---|---|
| ***F01P 7/14*** | (2006.01) |
| ***F01P 3/00*** | (2006.01) |
| ***F23N 1/00*** | (2006.01) |
| ***F01P 7/02*** | (2006.01) |
| ***B60H 1/22*** | (2006.01) |

(52) U.S. Cl.
USPC ..... 123/41.29; 123/41.09; 123/41.08; 236/25 R; 236/34; 236/34.5; 237/34

(58) Field of Classification Search
USPC ..... 123/41.29
See application file for complete search history.

(56) References Cited

U.S. PATENT DOCUMENTS

| | | | | |
|---|---|---|---|---|
| 3,211,374 | A * | 10/1965 | Matulaitis | 237/8 R |
| 4,369,738 | A * | 1/1983 | Hirayama | 123/41.1 |
| 4,370,950 | A * | 2/1983 | Furukubo | 123/41.08 |
| 4,413,596 | A * | 11/1983 | Hirayama | 123/41.1 |
| 4,539,942 | A * | 9/1985 | Kobayashi et al. | 123/41.1 |
| 5,121,714 | A * | 6/1992 | Susa et al. | 123/41.1 |
| 5,337,704 | A * | 8/1994 | Roth | 123/41.1 |
| 5,419,287 | A * | 5/1995 | Evans | 123/41.29 |
| 6,109,534 | A * | 8/2000 | Ito et al. | 237/12.3 B |

(Continued)

FOREIGN PATENT DOCUMENTS

| | | |
|---|---|---|
| JP | S57-167812 | 10/1982 |
| JP | 08-014043 | 1/1996 |

(Continued)

OTHER PUBLICATIONS

Office action dated Jul. 23, 2013 in corresponding Japanese Application No. 2010-102080.

*Primary Examiner* — Thanh Truong
*Assistant Examiner* — Tea Holbrook
(74) *Attorney, Agent, or Firm* — Harness, Dickey & Pierce, PLC

(57) ABSTRACT

In an engine, a block-side flow path for circulating cooling water to cool a cylinder block, and a head-side flow path for circulating cooling water to cool a cylinder head are formed. A head-side outlet temperature of cooling water flowing out of the head-side flow path is adjusted by using a water pump that pressure sends the cooling water to both the block-side flow path and the head-side flow path. A block-side outlet temperature of cooling water flowing out of the block-side flow path is adjusted by a first thermostat that changes a flow amount of the cooling water flowing out of the block-side flow path. The cooling water flowing out of the block-side flow path is used as a heat source of first and second heater cores for heating air.

18 Claims, 13 Drawing Sheets

(56) References Cited

U.S. PATENT DOCUMENTS

| | | | | |
|---|---|---|---|---|
| 6,758,171 | B2 * | 7/2004 | Hwang | 123/41.05 |
| 6,955,141 | B2 * | 10/2005 | Santanam et al. | 123/41.08 |
| 7,055,467 | B2 * | 6/2006 | Yi | 123/41.29 |
| 7,207,298 | B2 * | 4/2007 | Lee | 123/41.29 |
| 2006/0157002 | A1 * | 7/2006 | Pfeffinger et al. | 123/41.29 |
| 2007/0137592 | A1 * | 6/2007 | Hanai | 123/41.14 |
| 2007/0144464 | A1 * | 6/2007 | Muller | 123/41.29 |
| 2008/0034729 | A1 * | 2/2008 | Tafas | 60/39.182 |
| 2009/0056667 | A1 * | 3/2009 | Devine | 123/197.4 |
| 2009/0269211 | A1 * | 10/2009 | Matsutani et al. | 417/44.1 |
| 2011/0016899 | A1 * | 1/2011 | Ogura | 62/239 |

FOREIGN PATENT DOCUMENTS

| | | |
|---|---|---|
| JP | 11-036864 | 2/1999 |
| JP | 2003-507617 | 2/2003 |
| JP | 2005-036731 | 2/2005 |

* cited by examiner

ENGINE COOLING DEVICE

CROSS REFERENCE TO RELATED APPLICATION

This application is based on Japanese Patent Application No. 2010-102080 filed on Apr. 27, 2010, the contents of which are incorporated herein by reference in its entirety.

TECHNICAL FIELD

The present invention relates to an engine cooling device that cools an internal combustion engine by circulating cooling water.

BACKGROUND

There have been conventionally known engine cooling devices so configured as to circulate cooling water through an internal combustion engine (engine) that outputs a driving force for vehicle running, thereby to cool the engine. In general, cooling water circulated through this type of engine cooling devices is utilized as a heat source for heating air (fluid to be heated) sent into a vehicle compartment, in vehicle air conditioners.

For example, in the engine cooling device for vehicles described in Patent Document 1 (U.S. Pat. No. 5,337,704), an engine is provided therein with a head-side flow path circulating cooling water for cooling the cylinder head and a block-side flow path circulating cooling water for cooling the cylinder block, and cooling water flowing out of the head-side flow path is utilized as a heat source for heating air.

With respect to engines mounted in a vehicle, there is a demand that their output is increased without increasing their physical size. As a means for meeting this demand, there are known, for example, superchargers that supercharges air for fuel combustion (intake air) sucked into an engine and the like. In an engine equipped with a supercharger, however, the compression ratio in the combustion chamber is increased with increase in boost pressure and this makes knocking prone to occur.

Thus, in the engine equipped with a supercharger, the anti-knock performance is enhanced by such a means as lowering the temperature of a combustion chamber as compared with an engine without a supercharger. Therefore, when a supercharger is equipped in the engine in Patent Document 1, it is necessary to lower the temperature of the combustion chamber by such a means as increasing the flow amount of cooling water circulated through the head-side flow path.

However, this involves a problem. If the flow amount of cooling water circulated through the head-side flow path is increased to lower the temperature of the combustion chamber, the temperature of cooling water flowing out of the head-side flow path is also lowered. That is, the temperature of cooling water utilized as a heat source for heating air is also lowered. As a result, the temperature of the air cannot be sufficiently raised and there is a possibility that the air in the vehicle compartment cannot be appropriately conditioned (especially, heated).

SUMMARY

In consideration of the foregoing, it is an object of the invention to prevent a temperature decrease of a fluid to be heated even when temperature of a cooling water circulated through a head-side flow path is decreased, in an engine cooling device in which cooling water circulated therein is used as a heat source for heating the fluid to be heated.

According to a first example of the invention, an engine cooling device is for cooling an internal combustion engine by circulating cooling water and in which at least a part of cooling water flowing out of the internal combustion engine is used as a heat source for heating a fluid to be heated, and a block-side flow path for circulating cooling water for cooling a cylinder block and a head-side flow path for circulating cooling water for cooling a cylinder head are provided in the internal combustion engine. The engine cooling device includes: a cooling water pressure-feed unit disposed to pressure-feed cooling water to the block-side flow path and the head-side flow path; a first flow amount changing portion configured to change a flow amount of at least cooling water used as a heat source for heating the fluid, in the cooling water flowing out of the block-side flow path; a heat-radiation heat exchanger disposed to radiate heat from cooling water flowing out of the head-side flow path and cooling water flowing out of the block-side flow path to the outside air and for causing the cooling water to flow out to a suction side of the cooling water pressure-feed unit; a bypass passage provided to guide cooling water flowing out of the head-side flow path and cooling water flowing out of the block-side flow path to the suction side of the cooling water pressure-feed unit while bypassing the heat radiation heat exchanger; and a second flow amount changing portion configured to change a bypass flow amount of cooling water flowing through the bypass passage.

Furthermore, the second flow amount changing portion changes the bypass flow amount so that a suction-side temperature of cooling water on the suction side of the cooling water pressure-feed unit is approached to a reference suction-side temperature, a cooling water pumping capability of the cooling water pressure-feed unit is so controlled that a head-side outlet temperature of cooling water flowing out of the head-side flow path is approached to a reference head-side outlet temperature, the first flow amount changing portion changes the flow amount of cooling water for the heat source so that a block-side outlet temperature of cooling water flowing out of the block-side flow path is approached to a reference block-side outlet temperature, and the reference block-side outlet temperature has a value higher than the reference suction-side temperature.

Thus, with respect to the temperature of cooling water, the head-side outlet temperature is adjusted by a cooling water pressure-feed unit and the block-side outlet temperature is adjusted by a first flow amount changing portion. Therefore, the head-side outlet temperature and the block-side outlet temperature can be independently controlled.

In addition, the block-side outlet temperature can be made higher than head-side outlet temperature Thd by setting the reference block-side outlet temperature to a value higher than the reference suction-side temperature.

Therefore, it is possible to utilize a part of cooling water flowing out of the block-side flow path, higher in temperature than cooling water flowing out of the head-side flow path, as a heat source for heating fluid to be heated. Therefore, drop in the temperature of the fluid to be heated can be restricted even when the temperature of cooling water flowing through the head-side flow path is lowered.

Here, "changing the flow amount for heat source" or "changing the bypass flow amount" means not only to continuously change each flow amount but also to change it stepwise. Therefore, it also includes changing a flow amount in two stages, 0% (a state in which cooling water is not circulated) and 100% (a state in which cooling water is circulated).

For example, the first flow amount changing portion includes an electric first opening-closing valve that opens and closes a passage for cooling water used as the heat source. The engine cooling device further includes a first flow amount control portion configured to control operation of the first opening-closing valve, and a block-side outlet temperature detection portion configured to detect the block-side outlet temperature. Furthermore, the first flow amount control portion controls operation of the first opening-closing valve so that the detection value of the block-side outlet temperature detection portion is approached to the reference block-side outlet temperature.

Because the first flow amount changing portion includes the first opening-closing valve electrically operated, the flow amount for heat source can be changed stepwise by electrical control. Therefore, of the temperature of cooling water, the block-side outlet temperature can be accurately approached to the reference block-side outlet temperature.

Alternatively, the first flow amount changing portion includes an electric first flow regulating valve that adjusts the flow amount of cooling water for heat source by varying a valve opening. Furthermore, the engine cooling device further includes a first flow amount control portion configured to control operation of the first flow regulating valve, and a block-side outlet temperature detection portion configured to detect the block-side outlet temperature. Furthermore, the first flow amount control portion controls the operation of the first flow regulating valve so that a detection value of the block-side outlet temperature detection portion is approached to the reference block-side outlet temperature.

Because the first flow amount changing portion includes a first flow regulating valve electrically operated, the flow amount for heat source can be continuously changed by electrical control. Therefore, of the temperature of cooling water, the block-side outlet temperature can be accurately brought close to a reference block-side outlet temperature.

Furthermore, the first flow amount control portion may be configured to increase the reference block-side outlet temperature in accordance with a decrease of the outside air temperature.

Thus, the block-side outlet temperature of cooling water can be increased in conjunction with drop in the outside air temperature. That is, the temperature of cooling water used as a heat source for heating the fluid to be heated can be raised. Therefore, drop in the temperature of the fluid to be heated can be effectively restricted.

The engine cooling device may be further provided with a heating selection portion for a user to select whether to heat the fluid by using the cooling water. In this case, the first flow amount control portion has a means for setting the reference block-side outlet temperature. Furthermore, when the user selects to heat the fluid by using the heating selection portion, the setting means sets the reference block-side outlet temperature to a value lower than that when the user selects not to heat the fluid by using the heating selection portion.

Thus, the reference block-side outlet temperature is lower when it is selected to heat fluid to be heated than when it is selected not to heat the fluid to be heated. Therefore, when it is selected to heat the fluid to be heated, the first flow amount changing portion increases the flow amount of the cooling water for heat source. Consequently, the fluid to be heated can be rapidly heated in accordance with a user's request.

The cooling water pressure-feed unit may be an electric water pump. Furthermore, the engine cooling device may be provided a cooling water pumping-capability control portion configured to control a cooling water pumping capability of the cooling water pressure-feed unit, and a head-side outlet temperature detection portion configured to detect the head-side outlet temperature. In this case, the cooling water pumping-capability control portion controls operation of the cooling water pressure-feed unit so that the detection value of the head-side outlet temperature detection portion is approached to the reference head-side outlet temperature.

Because the cooling water pressure-feed unit is constructed of the electric water pump, the flow amount of cooling water circulated through the head-side flow path can be adjusted by electrical control. Consequently, of the temperature of cooling water, the head-side outlet temperature Thd can be accurately brought close to the reference head-side outlet temperature.

Furthermore, cooling water obtained by joining together cooling water flowing out of the head-side flow path and cooling water flowing out of the first flow amount changing portion may flow into a heating heat exchanger that heats the fluid, and a cooling water outlet of the heating heat exchanger may be connected to one of a suction side of the cooling water pressure-feed unit and an inlet side of the heat radiation heat exchanger.

Furthermore, cooling water flowing out of the head-side flow path may be caused to flow into a first heating heat exchanger that heats the fluid, cooling water flowing out of the first flow amount changing portion may be caused to flow into a second heating heat exchanger that heats the fluid, and cooling water outlets of the first and second heating heat exchangers may be connected to one of a suction side of the cooling water pressure-feed unit and an inlet side of the heat radiation heat exchanger.

Alternatively, cooling water obtained by joining together cooling water flowing out of the head-side flow path and a part of cooling water flowing out of the first flow amount changing portion may flow into a first heating heat exchanger that heats the fluid, another part of cooling water flowing out of the first flow amount changing portion may flow into a second heating heat exchanger that heats the fluid, and cooling water outlets of the first and second heating heat exchangers may be connected to one of a suction side of the cooling water pressure-feed unit and an inlet side of the heat radiation heat exchanger.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS (First Embodiment)

Figure 1:
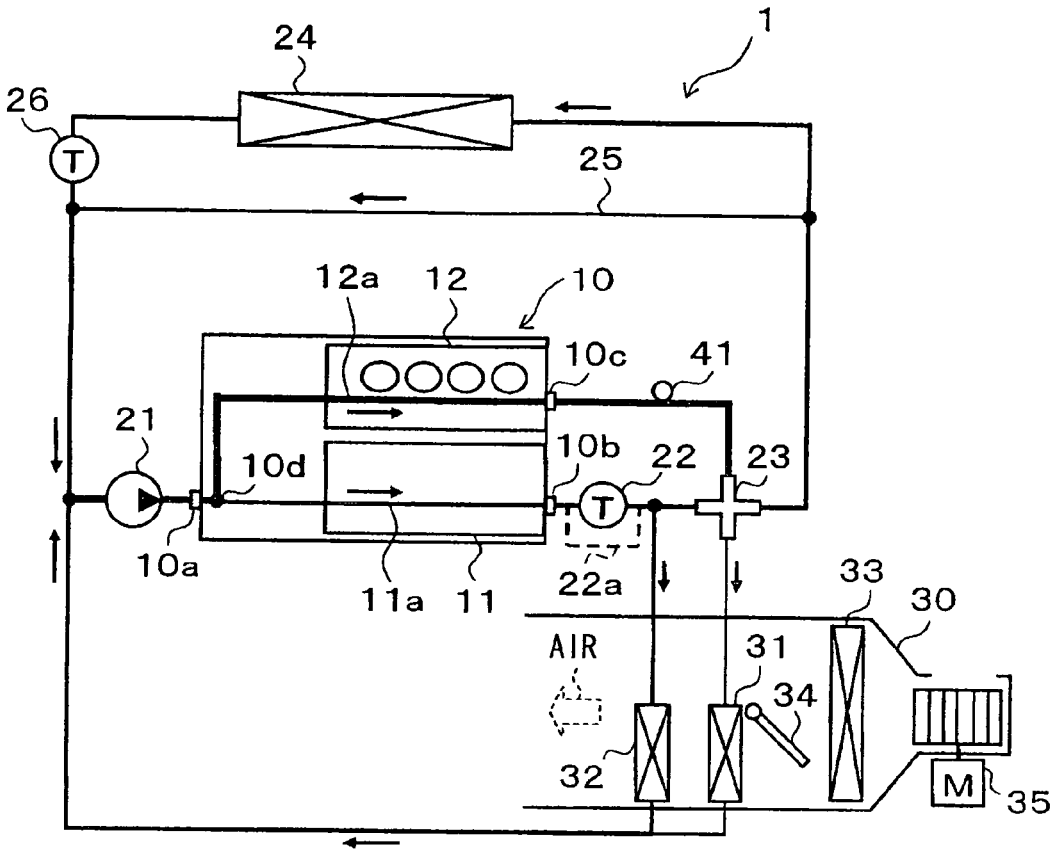
FIG. 1 is an overall schematic diagram of an engine cooling device in a first embodiment.

Description will be given to a first embodiment of the invention with reference to FIG. 1. FIG. 1 is an overall schematic diagram of an engine cooling device 1 in the first embodiment. In the present embodiment, the engine cooling device 1 is applied to a so-called hybrid vehicle in which driving force for vehicle running is obtained from an internal combustion engine (engine) 10 and an electric motor for vehicle-running. Therefore, the engine cooling device 1 in the present embodiment is adapted to cool the engine 10 of the hybrid vehicle.

Specifically, the engine cooling device 1 cools the engine 10 by circulating cooling water through cooling water flow paths 11*a*, 12*a* formed in the engine 10. This cooling water is also used as a heat source for heating air sent into the vehicle compartment in a vehicle air conditioner. In the present embodiment, therefore, air is an example of a fluid to be heated. As the cooling water, for example, ethylene glycol solution or the like can be adopted.

First, description will be given to the engine 10. In the present embodiment, a gasoline engine constructed of a cylinder block 11 and a cylinder head 12 is adopted as the engine 10. In an intake air passage of the engine 10, there is disposed a supercharger, not shown, that supercharges intake air drawn into each combustion chamber.

The cylinder block 11 is a metal block body defining cylinder bores in which a piston makes reciprocal motion. When the cylinder block 11 is mounted in a vehicle, it is provided below the cylinder bores with a crankcase that houses a crankshaft, a connecting rod coupling together the pistons and the crankshaft, and the like. The cylinder head 12 is a metal block body that closes the openings of the cylinder bores on the top dead center side and forms the combustion chambers together with the cylinder bores and the pistons.

A block-side flow path 11*a* for circulating cooling water for cooling the cylinder block 11 and a head-side flow path 12*a* for circulating cooling water for cooling the cylinder head 12 are formed integrally with each other, when the cylinder block 11 and the cylinder head 12 are integrally assembled together in the engine 10.

In FIG. 1, the directions of flow of cooling water circulated through the engine cooling device 1, the cooling water flow paths 11*a*, 12*a* in the engine 10, and the like are indicated by solid line arrows. The flow amount of cooling water circulated through each cooling water flow path 11*a*, 12*a* is schematically indicated by the thickness of the cooling water flow path. That is, the flow amount of cooling water circulated through the head-side flow path 12*a* represented by a very thick line is higher than the flow amount of cooling water circulated through the block-side flow path 11*a* represented by a thick line, in FIG. 1.

The inlet of the block-side flow path 11*a* and the inlet of the head-side flow path 12*a* are connected together at a flow dividing portion 10*d* disposed in the engine 10. The flow dividing portion 10*d* communicates with an inflow port 10*a* for causing the cooling water to flow therein from outside of the engine 10. The outlet of the block-side flow path 11*a* and the outlet of the head-side flow path 12*a* respectively communicate with first and second outflow ports 10*b*, 10*c* through which cooling water flows out of the engine 10.

Detailed description will be given to the configuration of the engine cooling device 1 in the present embodiment. A water pump 21 is a cooling water pressure-feed unit that pressure-feeds cooling water to the block-side flow path 11*a* and the head-side flow path 12*a* in the engine cooling device 1. Therefore, the cooling water discharge port of the water pump 21 is connected to the inflow port 10*a* of the engine 10.

More specifically, the water pump 21 in the present embodiment is constructed of an electrically operated water pump so configured that an impeller disposed in a casing for forming a pump chamber is driven by an electric motor. The rotation speed (cooling water pumping capability) of the electric motor is controlled by control voltage outputted from the engine controller, not shown, described later.

The first outflow port 10*b* through which cooling water flowing out of the block-side flow path 11*a* flows to outside of the engine 10 is connected with a first thermostat 22 as a first flow amount changing portion. The first thermostat 22 is a cooling water temperature responding valve constructed of a mechanical mechanism that displaces a valve body by thermowax (temperature-sensitive member) whose volume is varied according to temperature and thereby opens and closes a cooling water passage.

The first thermostat 22 opens its valve to let cooling water flow to the downstream side thereof, when the temperature of cooling water flowing out of the block-side flow path 11*a* (hereafter, referred to as block-side outlet temperature Tbk) becomes equal to or higher than a reference block-side outlet temperature KTbk (e.g., 90° C. in the present embodiment). In other words, the first thermostat 22 causes cooling water to flow to the downstream side thereof so that the block-side outlet temperature Tbk is brought close to the reference block-side outlet temperature KTbk.

As indicated by the broken line in FIG. 1, the first outflow port 10*b* is provided with a thermostat bypass passage 22*a*. The thermostat bypass passage 22*a* causes cooling water flowing out of the first outflow port 10*b* to flow to the downstream side of the first thermostat 22 while bypassing the first thermostat 22.

The thermostat bypass passage 22*a* passes only a very small quantity of cooling water and functions to dissipate the pressure of the cooling water in the block-side flow path 11*a* when bumping of cooling water occurs in the block-side flow path 11*a*. The thermostat bypass passage 22*a* may be formed in the first thermostat 22.

The outlet of the first thermostat 22 is connected with one cooling water inlet of a join portion 23 for joining together cooling water flowing out of the block-side flow path 11*a* and cooling water flowing out of the head-side flow path 12*a*.

The join portion 23 is of a four-way joint structure and has four cooling water inflow/outflow ports. Of the cooling water inflow/outflow ports, two are taken as cooling water inflow ports and two are taken as cooling water outflow ports.

Therefore, the other cooling water inflow port of the join portion 23 is connected with the second outflow port 10*c* through which cooling water flowing out of the head-side flow path 12*a* flows to the outside of the engine 10.

One cooling water outflow port of the join portion 23 is connected with a first heater core 31. The first heater core 31 is a first heat exchanger for heating that causes heat exchange between cooling water passing therein and air to be sent into the vehicle compartment so as to heat the air. More specifically, the first heater core 31 is disposed in the casing 30 of an interior air conditioning unit forming an air passage in the vehicle air conditioner.

The first heater core 31 is connected to the one cooling water outflow port of the join portion 23. Therefore, cooling water obtained by joining together cooling water flowing out of the head-side flow path 12*a* and a part of cooling water flowing out of the first flow amount changing portion 22 flows into the first heater core 31.

The cooling water passage extended from the outlet of the first thermostat 22 to the join portion 23 is connected with a branch passage for branching a flow of cooling water and guiding it to a second heater core 32. The basic configuration of the second heater core 32 is the same as that of the first heater core 31. The second heater core 32 is disposed in the air passage formed in the casing 30 downstream of the first heater core 31 in the air flow.

Therefore, the second heater core 32 is a second heat exchanger for heating that causes heat exchange between cooling water flowing therein and air having passed through the first heater core 31 and further heats the air. The branch passage is connected to the cooling water passage extended from the outlet of the first thermostat 22 to the join portion 23. Therefore, cooling water flowing out of the block-side flow path 11*a* (specifically, the first thermostat 22) mainly flows into the branch passage and the second heater core 32.

The cooling water outlets of the first and second heater cores 31, 32 are connected to the suction side of the water pump 21. Therefore, in the engine cooling device 1 of the present embodiment, the first thermostat 22 opens and closes its valve to change the flow amount of cooling water flowing to the downstream side thereof, and the flow amounts of cooling water flowing into the first and second heater cores 31, 32 are thereby changed. That is, the flow amount of cooling water used as a heat source for heating air (hereafter, referred to as flow amount for heat source) is thereby changed.

The other cooling water outflow port of the join portion 23 is connected with the cooling water inlet of a radiator 24. The radiator 24 is a heat exchanger for heat radiation that causes heat exchange between cooling water flowing out of the block-side flow path 11*d* and cooling water flowing out of the head-side flow path 12*a* and the outside air. It thereby dissipates the amount of heat in cooling water into the outside air. The cooling water outlet of the radiator 24 is connected to the suction side of the water pump 21.

The engine cooling device 1 is further provided with a bypass passage 25. The cooling water flowing out of the other cooling water outflow port of the join portion 23 flows to the suction side of the water pump 21 via the bypass passage 25 while bypassing the radiator 24. In the cooling water passage extended from the cooling water outlet of the radiator 24 to the joint point joined with the bypass passage 25, a second thermostat 26 is disposed as a second flow amount changing portion. The second thermostat 26 changes the flow amount of cooling water circulated through the bypass passage 25 (hereafter, referred to as bypass flow amount).

The basic configuration of the second thermostat 26 is the same as that of the first thermostat 22. More specifically, the second thermostat 26 closes its valve so that a part of cooling water flowing out of the other cooling water outflow port of the join portion 23 flows into the bypass passage 25, when the temperature of cooling water on the suction side of the water pump 21 (hereafter, referred to as suction-side temperature Tsuc) becomes equal to or lower than a reference suction-side temperature KTsuc (e.g., 65° C., in the present embodiment).

That is, the second thermostat 26 changes the bypass flow amount so that the suction-side temperature Tsuc is brought close to the reference suction-side temperature KTsuc. Thus, it is possible to restrict the cooling water from being excessively cooled at the radiator 24 and the cooling water temperature from being lowered beyond a temperature required for heating air, and to restrict the temperature of the engine 10 itself from dropping and friction loss from being caused by increase in the viscosity of engine oil or poor operation of an exhaust gas purifying catalyst from being caused by drop in the temperature of exhaust gas.

When the engine 10 is in normal operation, cooling water flowing into the engine 10 absorbs waste heat from the engine 10 and is heated. Therefore, it is desirable to set the reference block-side outlet temperature KTbk to a value higher than the reference suction-side temperature KTsuc. In the present embodiment, specifically, the reference block-side outlet temperature KTbk is set to 90° C. and the reference suction-side temperature KTsuc is set to 65° C. The temperature difference obtained by subtracting the reference suction-side temperature KTsuc from the reference block-side outlet temperature KTbk only has to be set to 20° C. to 30° C. or so.

Description will be given to the vehicle air conditioner in the present embodiment. The vehicle air conditioner in the present embodiment is of so-called air mix type and so configured that the temperature of air in the vehicle compartment is adjusted by adjusting a ratio of cold air cooled at a heat exchanger for cooling (in the present embodiment, the evaporator 33 of a generally known vapor-compression refrigeration cycle) disposed in the above-described casing 30 and warm air heated at the first and second heater cores 31, 32.

The air mix door 34 is driven by an electric actuator for air mix door and the operation of the electric actuator is controlled in accordance with control signals outputted from an air conditioning controller, not shown. On the most upstream side of the air passage in the casing 30, a blower 35 that sends air into the vehicle compartment is disposed. The blower 35 also has its number of rotations (amount of blowing) controlled by control voltage outputted from the air conditioning controller.

Description will be given to the engine controller and the air conditioning controller. The engine controller and the air conditioning controller are constructed of a generally known microcomputer including CPU, ROM, RAM, and the like and peripheral circuits thereof. Varied computation and processing are carried out based on control programs stored in the ROM and the operation of each device connected to their respective outputs is thereby controlled.

Specifically, the output side of the engine controller is connected to a starter for starting the engine 10, a drive circuit for a fuel injection valve for supplying fuel to the engine 10, an electric motor for the water pump 21, and the like.

On the input side of the engine controller, meanwhile, a group of the following sensors for engine control is connected: a number-of-engine-rotations sensor for detecting the number of engine rotations Nc; a vehicle speed sensor for detecting vehicle speed Vv; a head-side thermistor 41 for detecting the temperature of cooling water flowing out of the head-side flow path 12*a* (hereafter, referred to as head-side outlet temperature Thd) as a head-side outlet temperature detection portion; and the like.

The engine controller is configured by integrating control portions for controlling various control devices connected to the output side thereof. In the present embodiment, of the engine controller, a configuration (hardware and software) for controlling the operation of the electric motor for controlling the cooling water pumping capability of the water pump 21 is especially designated as cooling water pumping capability control portion.

On the output side of the air conditioning controller, there are connected the above-described electric actuator for air mix door, the blower 35, various constituent devices comprising the vapor compression refrigeration cycle, and the like. On the input side of the air conditioning controller, meanwhile, a group of the following sensors for air conditioning control is connected: an in-vehicle temperature sensor for detecting in-vehicle temperature Tr; an outside air temperature sensor for detecting outside air temperature Tam; a solar sensor for detecting the value Ts of solar radiation in the vehicle compartment; an evaporator temperature sensor for detecting the temperature (refrigerant evaporation temperature) Te of air blown out of the evaporator 33; and the like.

On the input side of the air conditioning controller, further, there is connected an operation panel disposed in the vehicle compartment. The operation panel is provided with an actuation switch for the vehicle air conditioning controller, a setting switch for the temperature in the vehicle compartment, a heating switch for an occupant (user) to select whether to turn on the heater, that is, a heating selecting portion for selecting whether to heat air, and the like.

The engine controller and the air conditioning controller in the present embodiment are electrically connected with each other and capable of communicating with each other. This makes it possible for either controller to control the operation of each device connected to the output side thereof based on a detection signal or an operation signal inputted to the other controller. Therefore, the engine controller and the air conditioning controller may be integrally configured as a single controller.

Description will be given to the operation of the embodiment having the above configuration. First, description will be given to the operation of the engine 10. When a vehicle start switch is turned on and the vehicle is started up, the engine controller reads detection signals from the group of the various sensors for engine control connected to the input thereof in a predetermined control cycle. Then it detects the running load on the vehicle based on the read detection values. Further, it actuates or stops the engine 10 according to the detected running load.

Thus, the running state of the hybrid vehicle is switched between the following running states: a running state in which the vehicle runs by obtaining driving force both from the engine 10 and from the electric motor for running; a running state or a so-called EV running state, in which the engine is stopped and driving force is obtained only from the electric motor for running; and the like. In the hybrid vehicle, as a result, the fuel economy can be enhanced as compared with ordinary vehicles having only an engine 10 as a driving source for vehicle running.

Description will be given to the operation of the engine cooling device 1. When the vehicle start switch is turned on and the vehicle is started up, the cooling water pumping capability control portion of the engine controller reads a detection value from the head-side thermistor 41 in a predetermined control cycle. Then it outputs control voltage to the electric motor for the water pump 21 so that the detection value is brought close to a reference head-side outlet temperature KThd (e.g., 70° C. in the present embodiment) stored beforehand in the engine controller.

Specifically, the cooling-water pumping capability control portion carries out the processing described below. When the detection value from the head-side thermistor 41 becomes equal to or higher than the reference head-side outlet temperature KThd, it increases the cooling water pumping capability (discharge flow amount) of the water pump 21. When the detection value from the head-side thermistor 41 becomes equal to or lower than a temperature lower by a predetermined amount a than the reference head-side outlet temperature KThd, it reduces the cooling water pumping capability (discharge flow amount) of the water pump 21. The predetermined amount $\alpha$ is a value set as hysteresis width for preventing control hunting.

Therefore, in the engine cooling device 1 of the present embodiment, the flow amount of cooling water circulated through the head-side flow path 12*a* is adjusted so that the temperature on the cylinder head 12 side of the engine 10 becomes approximately 70° C. With respect to the cylinder block 11 side, the flow amount of cooling water circulated through the block-side flow path 11*d* is adjusted so that the temperature of the cylinder block 11 becomes equal to approximately 90° C. (equivalent to the reference block-side outlet temperature KTbk) by using the first thermostat 22.

As a result, the temperature of cooling water circulated through the second heater core 32 into which cooling water flowing out of the block-side flow path 11*a* mainly flows becomes higher than the temperature of cooling water circulated through the first heater core 31 into which cooling water obtained by joining together cooling water flowing out of the block-side flow path 11*a* and cooling water flowing out of the head-side flow path 12*a* flows.

With respect to the cooling water flowing out of the other cooling water outflow port of the join portion 23, the flow amount of cooling water flowing through the radiator 24 or the bypass passage 25 is adjusted. This adjustment is made by opening and closing the second thermostat 26 so that the suction-side temperature Tsuc is brought close to 65° C. (reference suction-side temperature KTsuc).

Description will be given to the operation of the vehicle air conditioner. When the actuation switch for the air condition is turned on (ON) with the vehicle start switch on, the air conditioning controller reads detection signals from the group of sensors for air conditioning control and operation signals from the operation panel. Then, based on the values of the detection signals and the operation signals, it calculates a target blow-out temperature TAO, which is the target temperature of air blown out into the vehicle compartment.

Specifically, the target blow-out temperature TAO is calculated by using Formula I below:

$$TAO = Kset \times Tset - Kr \times Tr - Kam \times Tam - Ks \times Ts + C \quad \text{(F1)}$$

where, Tset is a vehicle-interior set temperature set with the temperature setting switch; Tr is the temperature in the vehicle compartment (in-vehicle temperature) detected by the in-vehicle temperature sensor; Tam is the outside air temperature detected by the outside air temperature sensor; Ts is the value of solar radiation detected by the solar sensor; Kset, Kr, Kam, and Ks are control gains; and C is a constant for correction.

The air conditioning controller further determines the operating state of various air conditioning control devices connected to the output side thereof based the calculated target blow-out temperature TAO and the detection signals from the group of sensors.

For example, the following processing is carried out with respect to the target blowing amount of the blower 35, that is, the control voltage outputted to the electric motor for the blower 35: a control map stored beforehand in the air conditioning controller based on the target blow-out temperature TAO is referred to; and it is determined so that the target blow-out temperature TAO is higher at the time of high temperature and the time of low temperature than at the time of intermediate temperature.

With respect to the control signal outputted to the servo motor for the air mix door 34, it is determined whether the temperature of air blown out into the vehicle compartment becomes equal to an occupant's desired temperature set with the in-vehicle temperature setting switch, by using the target blow-out temperature TAO, the detection value of the temperature Te of air blown out from the evaporator 33, and the detection value from the head-side thermistor 41.

When the occupant selects to heat the interior of the vehicle compartment with the heating switch, the opening of the air mix door 34 may be so controlled that all the amount of air sent from the blower 35 passes through the first and second heater cores 31, 32. Further, the operation of the compressor of the refrigeration cycle may be stopped.

The control voltage and control signals determined as mentioned above are outputted to the various air conditioning control devices. Thereafter, the following control routine is repeated in a predetermined control cycle until stopping the operation of the vehicle air conditioner is requested through the operation panel: a control routine of reading the above-described detection signals and operation signals→calculating the target blow-out temperature TAO→determining the operating states of various air conditioning control devices→outputting control voltage and control signals.

In the vehicle air conditioner, therefore, air from the blower 35 is cooled when air passes through the evaporator 33. Further, the air from the evaporator 33 is heated when it passes through the first heater core 31 and the second heater core 32 in this order, and then is blown out into the vehicle compartment.

At this time, as described above, the temperature of cooling water circulated through the first heater core 31 is lower than the temperature of cooling water circulated through the second heater core 32. Therefore, it is possible to ensure a temperature difference between the cooling water in the first heater core 31 and air and a temperature difference between the cooling water in the second heater core 32 and air to efficiently heat the air.

Since the engine cooling device 1 in the present embodiment operates as mentioned above, the following beneficial effects can be obtained.

Of the temperature of cooling water, the head-side outlet temperature Thd is adjusted by the cooling water pumping capability of the water pump 21, and the block-side outlet temperature Tbk is adjusted by opening or closing the first thermostat 22. Therefore, the head-side outlet temperature Thd and the block-side outlet temperature Tbk can be respectively controlled to independent temperatures.

At this time, the reference block-side outlet temperature KTbk is set to a value higher than the reference suction-side temperature KTsuc. This makes it possible to make the block-side outlet temperature Tbk of the temperature of cooling water higher than the head-side outlet temperature Thd. That is, it is possible to utilize a part of cooling water flowing out of the block-side flow path 11*a* that becomes higher in temperature than cooling water flowing out of the head-side flow path 12*a* as a heat source for heating air.

In conventional technologies, only cooling water flowing out of the head-side flow path 12*a* is let to flow into a heater core and is utilized as a heat source for heating air. According to the foregoing, meanwhile, drop in the temperature of air can be restricted even though the temperature of cooling water circulated through the head-side flow path 12*a* is lowered. As a result, it is possible to reduce harmful effect on the heating performance of a vehicle air conditioner even though the temperature of cooling water circulated through the head-side flow path 12*a* is lowered.

In engines 10 with a supercharger applied thereto like the embodiment, lowering the temperature of cooling water circulated through the head-side flow path 12*a* is highly effective in that the antiknock performance can be enhanced.

The engine cooling device 1 in the present embodiment adopts the electrically operated water pump 21 as a cooling water pressure-feed unit, and therefore, the flow amount of cooling water flowing through the head-side flow path 12*a* can be adjusted by electrical control. This makes it possible to accurately bring the head-side outlet temperature Tbd of the temperature of cooling water close to the reference head-side outlet temperature KThd.

(Second Embodiment)

Figure 2:
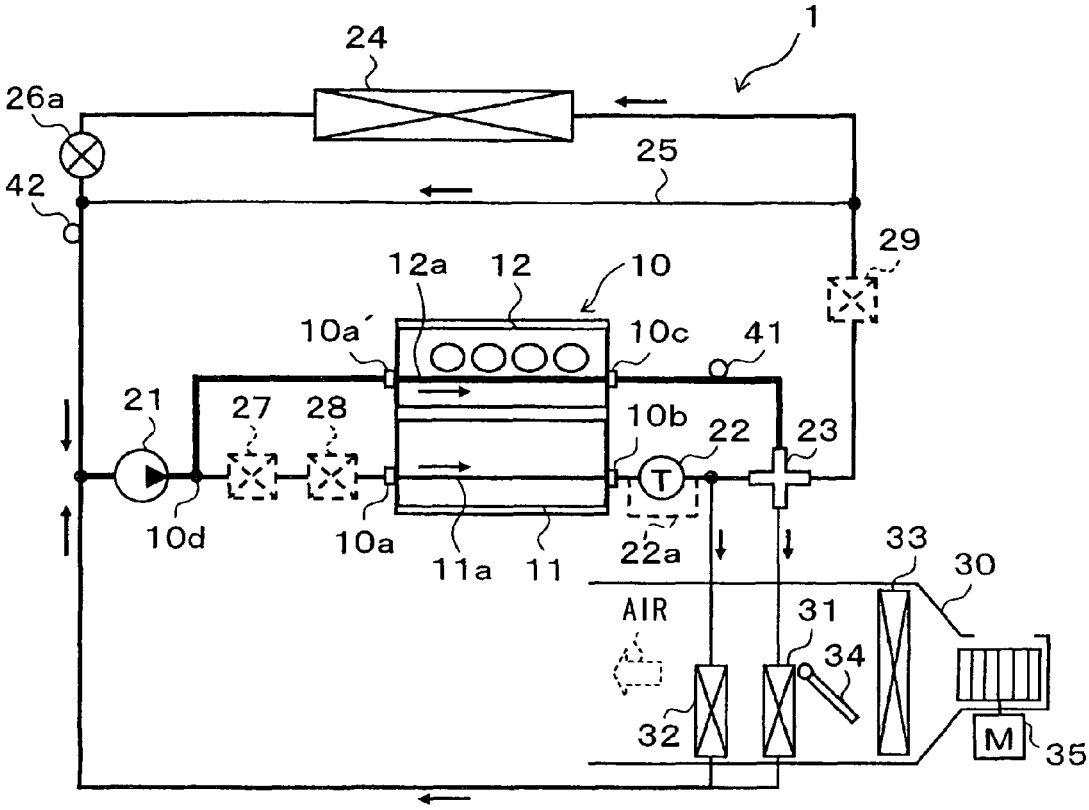
FIG. 2 is an overall schematic diagram of an engine cooling device in a second embodiment.

In a second embodiment, as illustrated in the overall schematic diagram in FIG. 2, the intake air and exhaust gas of the engine 10 can be cooled by the engine cooling device 1, and the configuration of the second flow amount changing portion is so modified that it can be electrically controlled, with respect to the above-described first embodiment. In FIG. 2, the same or similar parts as in the first embodiment are marked with the same reference numerals. This is the same with the following drawings.

More specific description will be given. In the engine cooling device 1 in the present embodiment, the flow dividing portion 10*d* that divides the flow of cooling water flowing out of the water pump 21 is disposed outside the engine 10. In the cooling water passage extended from the flow dividing portion 10*d* to the inflow port 10*a* of the engine 10, there are provided various exhaust gas coolers 27, 28 for performing heat exchange between the exhaust gas of the engine 10 and cooling water.

As the exhaust gas coolers, an EGR cooler 27 and an exhaust manifold cooler 28 are disposed in an exhaust gas recirculation system (hereafter, simply referred to as EGR system) that returns a part of exhaust gas to the intake air side. The EGR cooler 27 performs heat exchange between exhaust gas returned to the intake air side and cooling water to cool the exhaust gas. The exhaust manifold cooler 28 performs heat exchange between exhaust gas circulated through an exhaust manifold that aggregates exhaust gas immediately after it is discharged from each cylinder of the engine 10 and cooling water to cool the exhaust gas.

In the cooling water passage extended from the other cooling water outflow part of the join portion 23 to the bypass passage 25 and the inlet of the radiator 24, an intercooler (turbo cooler) 29 is disposed. The intercooler 29 performs heat exchange between intake air supercharged into each combustion chamber and cooling water to cool the intake air.

It is not necessary to install all of the EGR cooler 27, exhaust manifold cooler 28, and intercooler 29. The invention may be so configured that any of the heat exchangers is installed. The cooling water flowing from the flow dividing portion 10*d* into the head-side flow path 12*a* flows into the engine 10 through a second inflow port 10*a'*.

In the engine cooling device 1 in the present embodiment, the configuration of the second flow amount changing portion is so modified that it can be electrically controlled. As the second flow amount changing portion, specifically, a second opening-closing valve 26*a* that opens or closes the cooling water passage extended from the cooling water outlet side of the radiator 24 to the joint with the bypass passage 25 is adopted. The second opening-closing valve 26*a* is an electromagnetic valve whose operation is controlled by control voltage outputted from the engine controller.

In the present embodiment, a suction-side thermistor 42 is added as a suction-side temperature detection portion that detects a suction-side temperature Tsuc. The suction-side thermistor 42 is connected to the input side of the engine controller. In the present embodiment, of the engine controller, a configuration (hardware and software) for controlling the operation of the second opening-closing valve 26*a* is especially designated as second flow amount control portion. The other configuration elements are similar to those in the first embodiment.

Figure 3:
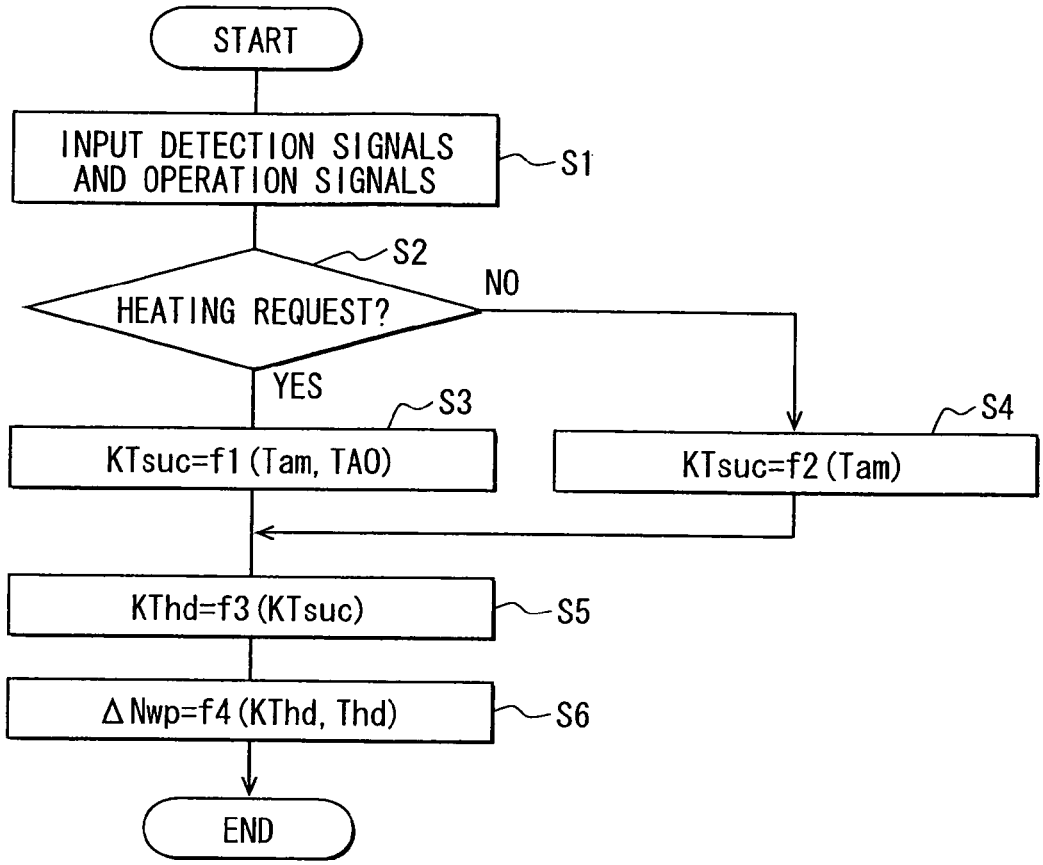
FIG. 3 is a flowchart illustrating control processing by an engine controller in the second embodiment.

Description will be given to the operation of the embodiment. The basic operations of the engine 10 and the vehicle air conditioner are similar to those in the first embodiment. Description will be given to the operation of the engine cooling device 1 with reference to the flowchart in FIG. 3 and the control characteristic diagrams in FIGS. 4A to 7. The flowchart shown in FIG. 3 illustrates the processing carried out as a subroutine of a main routine performed by the engine controller when the vehicle start switch is turned on and the vehicle is started up.

At Step S1, first, detection signals from the group of sensors for engine control, detection signals from the group of sensors for air conditioning control, operation signals from the operation panel, a target blow-out temperature TAO calculated at the air conditioning controller and the like are read. Detection signals from the group of sensors for air conditioning control, operation signals from the operation panel, and the target blow-out temperature TAO are read from the air conditioning controller:

At Step S2, subsequently, it is determined based on the operation signal from the heating switch read at Step S1 whether or not heating the interior of the vehicle compartment is requested (selected). When it is determined at Step S2 that heating is requested (selected), the control program proceeds to Step S3. Then, a reference suction-side temperature KTsuc is determined as indicated by the control characteristic diagrams in FIGS. 4A and 4B and the control program proceeds to Step S5.

Figure 4A:
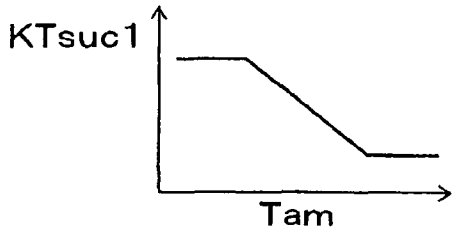
FIG. 4A is a control characteristic diagram indicating the relation between an outside air temperature (Tam) and a reference suction-side temperature (KTsuc1) in the second embodiment.
Figure 4B:
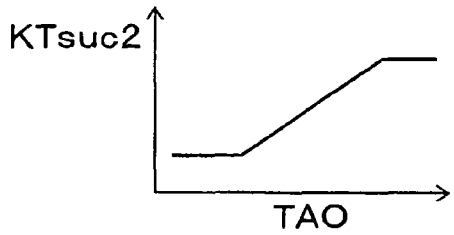
FIG. 4B is a control characteristic diagram indicating the relation between a target blow-out temperature (TAO) and a reference suction-side temperature (KTsuc2) in the second embodiment.

More specific description will be given. At Step S3, by using a control map stored beforehand in the engine controller, a first temporary reference suction-side temperature KTsuc1 is determined to be decreased in accordance with an increase in the outside air temperature Tam, and a second temporary reference suction-side temperature KTsuc2 is determined to be increased in accordance with an increase in the target blow-out temperature TAO. Further, KTsuc1 or KTsuc2, whichever is higher, is determined as the reference suction-side temperature. In FIG. 3, the control characteristic diagrams in FIGS. 4A and 4B are represented by a function of f1(Tam, TAO)=MAX(KTsuc1, KTsuc2).

When it is determined at Step S2 that heating is not requested (selected), the control program proceeds to Step S4. Then, a reference suction-side temperature KTsuc is determined as indicated by the control characteristic diagram in FIG. 5 and the control program proceeds to Step S5.

Figure 5:
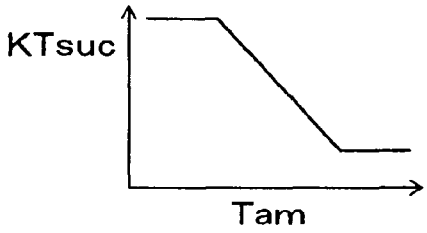
FIG. 5 is a control characteristic diagram indicating the relation between the outside air temperature (Tam) and a reference suction-side temperature (KTsuc) in the second embodiment.

More specific description will be given. At Step S4, a control map stored beforehand in the engine controller is referred to and a reference suction-side temperature KTsuc is determined to be decreased in accordance with an increase in an outside air temperature Tam. In FIG. 3, the control characteristic diagram in FIG. 5 is represented by a function of f2(Tam). The reference suction-side temperature KTsuc determined at Step S5 is set to a high temperature, even when the outside air temperature Tam is the same with respect to KTsuc1 at Step S3.

Figure 6:
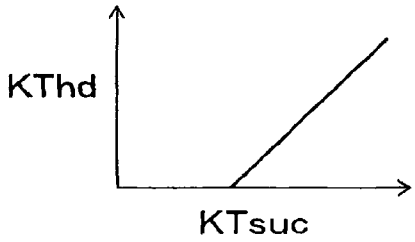
FIG. 6 is a control characteristic diagram indicating the relation between the reference suction-side temperature (KTsuc) and a reference head-side temperature (KThd) in the second embodiment.

At Step S5, a reference head-side outlet temperature KThd is determined as indicated by the control characteristic diagram in FIG. 6. At Step S5, specifically, by using a control map stored beforehand in the engine controller, the reference head-side outlet temperature KThd is determined to be increased based on an increase in the reference suction-side temperature KTsuc determined at Step S3 or S4. In FIG. 3, the control characteristic diagram in FIG. 6 is represented by a function of f3(KTsuc).

Figure 7:
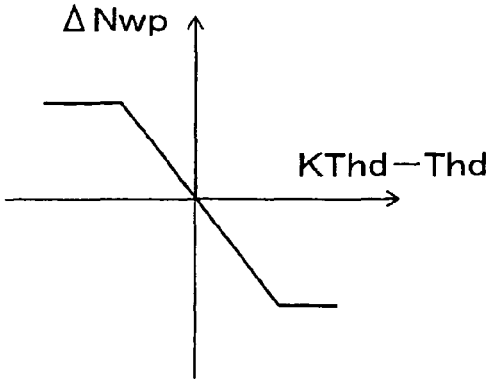
FIG. 7 is a control characteristic diagram indicating the relation between the reference head-side outlet temperature, the head-side outlet temperature, and the amount of change in the rotation speed of a water pump in the second embodiment.

At Step S6, the amount of change in the rotation speed (cooling water pumping capability) of the water pump 21 is determined as indicated by the control characteristic diagram in FIG. 7. That is, the amount of change in control voltage outputted to the electric motor for the water pump 21 is determined. Then, the control program returns to the main routine.

More specific description will be given. At Step S6, amount of change ΔNwp in the rotation speed of the water pump 21 is determined, so that the amount of change ΔNwp is reduced with increase in the deviation ΔThd (KThd-Thd) obtained by subtracting the head-side outlet temperature Thd from the reference head-side outlet temperature KThd.

More specifically, when the deviation ΔThd takes a positive value, the rotation speed of the water pump 21 is reduced with increase in deviation ΔThd; and when the deviation ΔThd takes a negative value, the rotation speed of the water pump 21 is increased with reduction in deviation ΔThd. In FIG. 3, the control characteristic in FIG. 7 is represented by a function of f4 (KThd,Thd).

In the main routine, the second flow amount control portion of the engine controller reads a detection value from the suction-side thermistor 42 in a predetermined control cycle. Then, it outputs control voltage to the second opening-closing valve 26*a* so that the detection value is brought close to the reference suction-side temperature KTsuc determined by the above-described subroutine.

More specifically, in the second flow amount control portion, when the detection value from the suction-side thermistor 42 becomes equal to or higher than the reference suction-side temperature KTsuc, the second opening-closing valve 26*a* is opened to guide cooling water into the radiator 24. When the detection value from the suction-side thermistor 42 becomes equal to or lower than a temperature lower by a predetermined amount βthan the reference suction-side temperature KTsuc, the second opening-closing valve 26*a* is closed. The predetermined amount β is a value set as hysteresis width for preventing control hunting.

The cooling water pumping capability control portion outputs control voltage to the electric motor for the water pump 21, so that the rotation speed (cooling water pumping capability) of the water pump 21 changes by the amount of change ΔNwp determined at Step S6.

Since the engine cooling device 1 in the present embodiment operates as mentioned above, the head-side outlet temperature Thd and the block-side outlet temperature Tbk can be independently controlled, and the block-side outlet temperature Tbk can be made higher than the head-side outlet temperature Thd, similarly to the above-described first embodiment. Therefore, it is possible to suppress drop in the temperature of air even when the temperature of cooling water circulated through the head-side flow path 12*a* is lowered and to reduce harmful effect on the heating performance of the vehicle air conditioner.

In the present embodiment, the second opening-closing valve 26*a* is adopted as the second flow amount changing portion; therefore, the suction-side temperature Tsuc can be accurately controlled by electrical control. In addition, the measure described in relation to Steps S3 and S4 is taken. That is, when an occupant does not request heating, the reference suction-side temperature KTsuc is determined as a higher value than when an occupant requests heating.

Therefore, when heating is requested (selected), the block-side outlet temperature Tbk can be quickly raised. Thus it is possible to quickly raise the temperature of cooling water flowing into the first and second heater cores 31, 32 and swiftly accomplish heating in the vehicle compartment.

As described in relation to Steps S3 and S5, the reference suction-side temperature KTsuc is determined as a higher value with drop in outside air temperature Tam. Therefore, it is easier to raise the block-side outlet temperature Tbk when the outside air temperature is low and necessity for heating is high and further swiftly accomplish heating in the vehicle compartment.

The second embodiment is provided with the EGR cooler 27, exhaust manifold cooler 28, and intercooler 29. Therefore, it is also possible to cool exhaust gas returned to the intake air side, exhaust gas circulated through the exhaust manifold, and intake air supercharged into each combustion chamber. At this time, in the engine cooling device 1 in the present embodiment, as mentioned above, the head-side outlet temperature Thd and the block-side outlet temperature Tbk can be independently controlled. Therefore, even when the heat exchangers are installed, they do not have harmful effect on the heating performance of the vehicle air conditioner.

(Third Embodiment)

Figure 8:
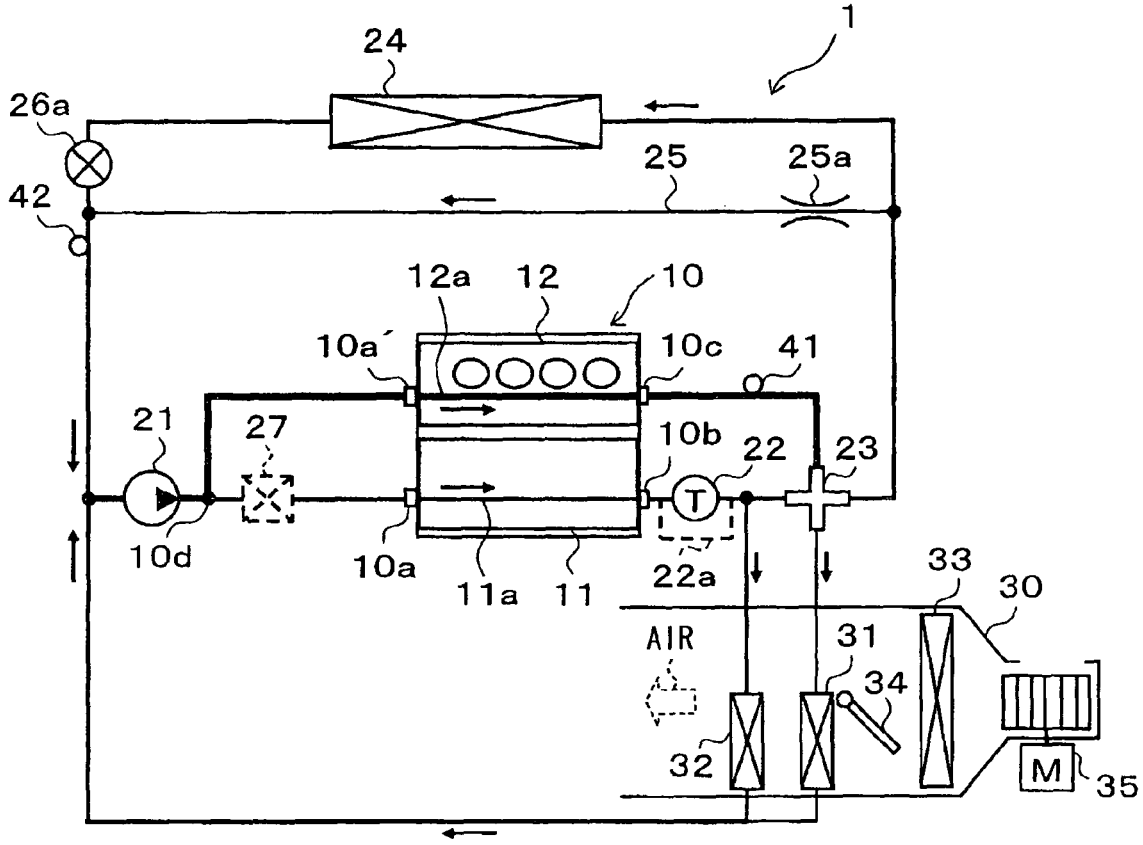
FIG. 8 is an overall schematic diagram of an engine cooling device in a third embodiment.

A third embodiment is obtained by adding a fixed throttle 25*a* that increases the passage resistance when cooling water is circulated through the bypass passage 25 to the second embodiment as illustrated in the overall schematic diagram in FIG. 8. This makes it possible not only to obtain the same effect as in the second embodiment but also to prevent the bypass flow amount from being abruptly increased when the second opening-closing valve 26*d* is closed.

Therefore, it is possible to suppress rapid fluctuation in the suction-side temperature Tsuc, the head-side outlet temperature Thd and further the block-side outlet temperature Tbk. Consequently, rapid fluctuation can be restricted also with respect to the temperature of cooling water flowing into the first and second heater cores 31, 32. In the vehicle air conditioner, as a result, it is possible to accomplish heating high in air conditioning quality in which rapid fluctuation is restricted.

Figure 9:
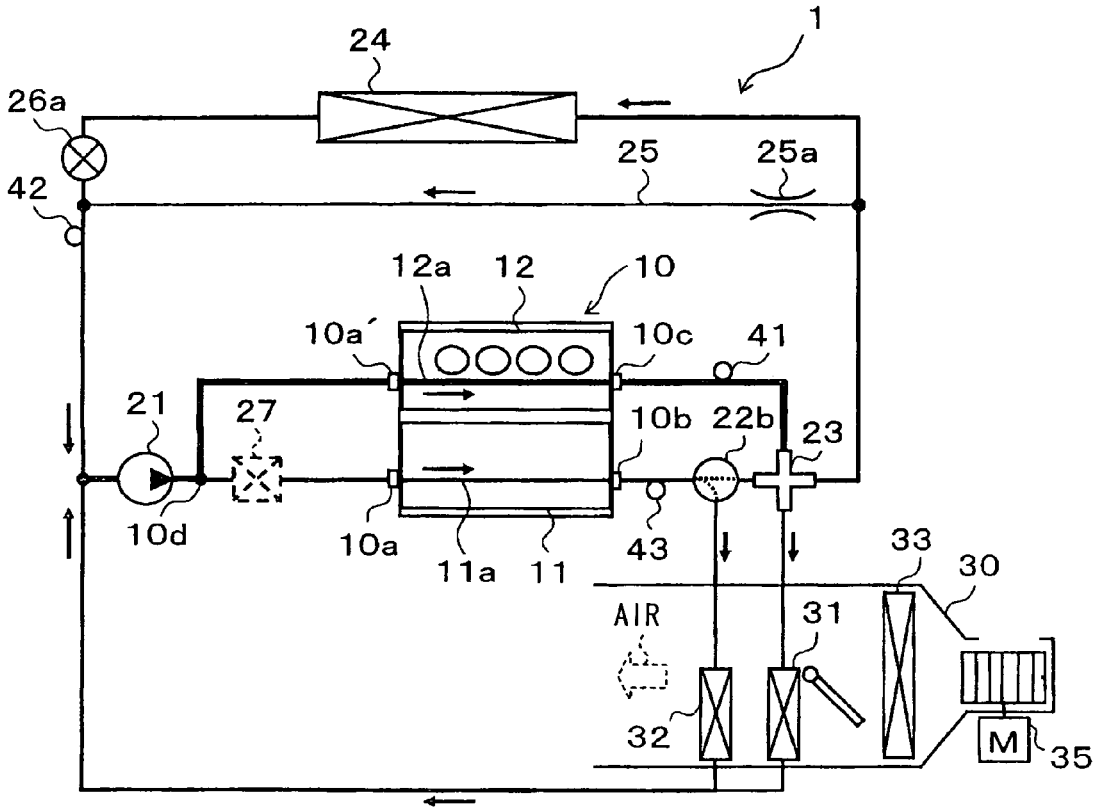
FIG. 9 is an overall schematic diagram of an engine cooling device in a fourth embodiment.

To make the graphical representation understandable, the exhaust manifold cooler 28 and the intercooler 29 are omitted from FIG. 9. The EGR cooler 27, exhaust manifold cooler 28, and intercooler 29 may be all provided as in the second embodiment or they may be not provided as in the first embodiment.

(Fourth Embodiment)

In a fourth embodiment, as illustrated in the overall schematic diagram in FIG. 9, the configuration of the first flow amount changing portion in the above-described third embodiment is modified so that the first flow amount changing portion can be electrically controlled.

Specifically, a three-way first flow regulating valve 22*b* is adopted as first flow amount changing portion. The first flow regulating valve 22*b* continuously varies the flow amount of the cooling water flowing from the block-side flow path 11*a* toward the second heater core 32 and the flow amount of the cooling water flowing from the block-side flow path 11*a* toward the join portion 23. The operation of the first flow regulating valve 22*b* is controlled by control signals outputted from the engine controller.

In the present embodiment, further, a block-side thermistor 43 is added as a block-side outlet temperature detection portion for detecting the block-side outlet temperature Tbk of cooling water flowing out of the first outflow port 10*b* of the engine 10. The block-side thermistor 43 is connected to the input side of the engine controller.

In the present embodiment, of the engine controller, a configuration (hardware and software) for controlling the operation of the first flow regulating valve 22*b* is especially designated as first flow amount control portion. The other configuration elements are the same as those in the second embodiment.

Figure 10:
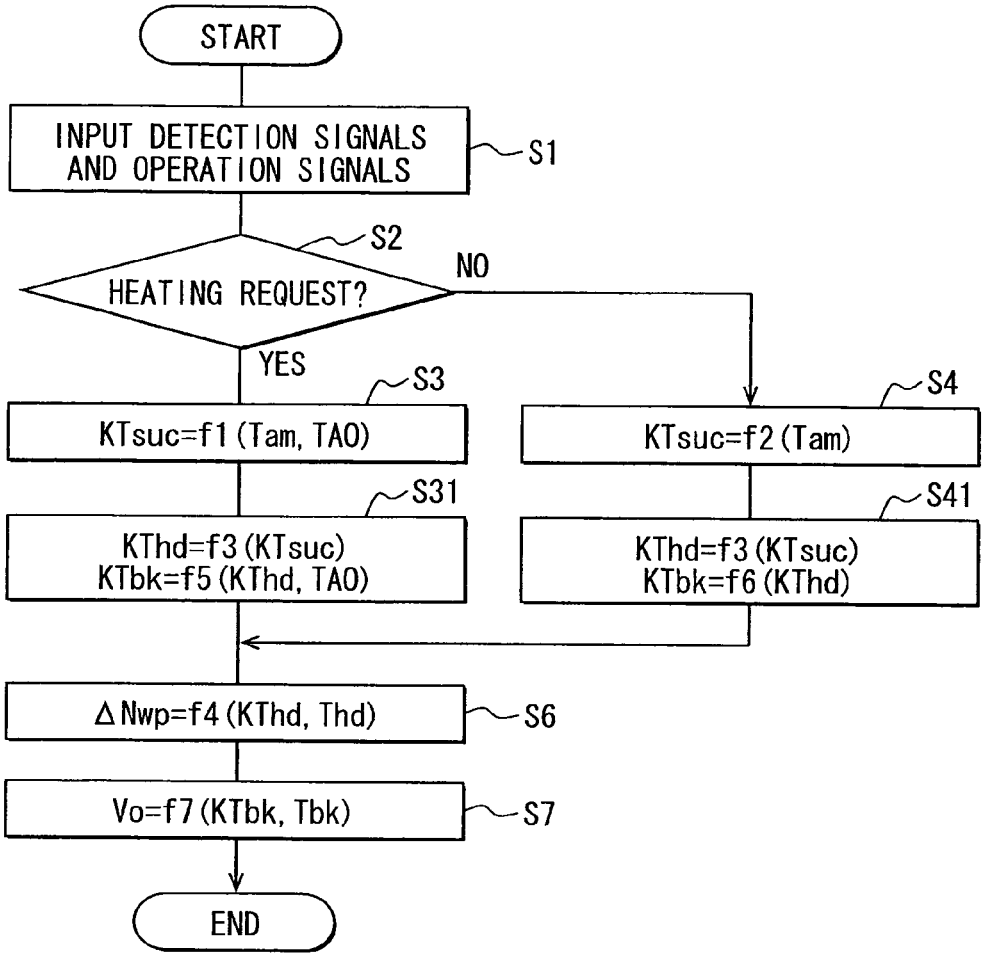
FIG. 10 is a flowchart illustrating control processing by an engine controller in the fourth embodiment.

Description will be given to the operation of this embodiment. The basic operations of the engine 10 and the vehicle air conditioner are the same as those in the first embodiment. Description will be given to the operation of the engine cooling device 1 with reference to the flowchart in FIG. 10 and the control characteristic diagrams in FIGS. 11A to 14. The flowchart shown in FIG. 10 illustrates the processing carried out as a subroutine as in the second embodiment.

Each control processing at Steps S1 to S4 is the same as that in the second embodiment. When it is determined at Step S2 that heating is requested (selected) in the present embodiment, the control program proceeds to Step S3. Then a reference suction-side temperature KTsuc is determined as indicated by the control characteristic diagrams in FIGS. 4A and 4B as in the second embodiment and the control program proceeds to Step S31.

At Step S31, a reference head-side outlet temperature KThd is determined as indicated by the control characteristic diagram in FIG. 6 as at Step S5 in the second embodiment. At the same time, a reference block-side outlet temperature KTbk is determined as indicated by the control characteristic diagrams in FIGS. 11A and 11B and the control program proceeds to Step S6.

More specific description will be given. At Step S31, a control map stored beforehand in the engine controller is referred to. Then a first temporary reference block-side outlet temperature KTbk1 is determined so that it is raised with rise in reference head-side outlet temperature KThd; and a second temporary reference block-side outlet temperature KTbk2 is determined so that it is lowered with rise in target blow-out temperature TAO. Further, KTbk1 or KTbk2, whichever is lower, is determined as the reference block-side outlet temperature.

Figure 11A:
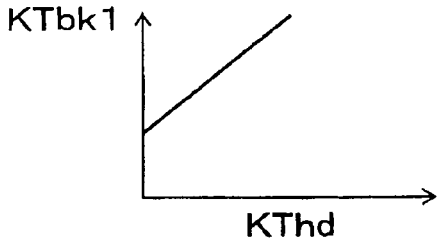
FIG. 11A is a control characteristic diagram indicating the relation between a reference head-side outlet temperature (KThd) and a reference block-side outlet temperature (KTbk1) in the fourth embodiment.
Figure 11B:
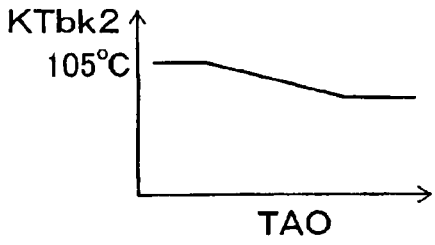
FIG. 11B is a control characteristic diagram indicating the relation between a target blow-out temperature (TAO) and a reference block-side outlet temperature (KTbk2) in the fourth embodiment.

In FIG. 10, the control characteristic diagrams in FIGS. 11A and 11B are represented by a function of f5(KThd, TAO)=min(KTbk1 Jabk2). In the present embodiment, the maximum value of the second temporary reference block-side outlet temperature KTbk2 is set to 105° C. for preventing overheating of the engine 10.

Meanwhile, when it is determined at Step S2 that heating is not requested (selected), the control program proceeds to Step S4. Then a reference suction-side temperature KTsuc is determined as indicated by the control characteristic diagram in FIG. 5 as in the second embodiment and the control program proceeds to Step S41.

At Step S41, a reference head-side outlet temperature KThd is determined as indicated by the control characteristic diagram in FIG. 6 as at Step S5 in the second embodiment. At the same time, a reference block-side outlet temperature KTbk is determined as indicated by the control characteristic diagram in FIG. 12 and the control program proceeds to Step S6.

Figure 12:
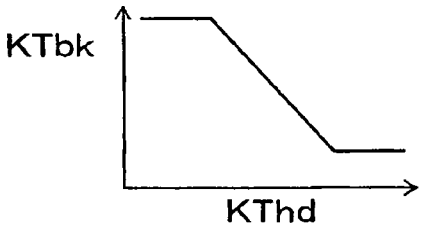
FIG. 12 is a control characteristic diagram indicating the relation between the reference head-side outlet temperature (KThb) and a reference block-side outlet temperature (KThk) in the fourth embodiment.

More specific description will be given. At Step S41, a control map stored beforehand in the engine controller is referred to and a reference block-side outlet temperature KTbk is determined so as to be decreased in accordance with an increase in reference head-side outlet temperature KThd. In FIG. 10, the control characteristic diagram in FIG. 12 is represented by a function of f6(KThd).

At Step S6, subsequently, the amount of change in the rotation speed (cooling water pumping capability) of the water pump 21 is determined as indicated by the control characteristic diagram in FIG. 7 as in the second embodiment. That is, the amount of change in control voltage outputted to the electric motor for the water pump 21 is determined. Then the control program proceeds to Step S7.

Figure 13:
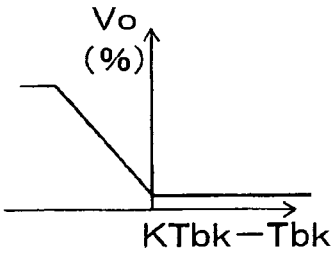
FIG. 13 is a control characteristic diagram indicating the relation between the reference block-side outlet temperature (KThk), a block-side outlet temperature (Tbk), and a valve opening (Vo) of a first flow regulating valve in the fourth embodiment.

At Step S7, the valve opening of the first flow regulating valve 22*b* is determined as indicated by the control characteristic diagram in FIG. 13 and the flow returns to the main routine. At Step S7, specifically, the valve opening Vo of the first flow regulating valve 22*b* is determined so that the valve opening Vo is reduced with increase in the deviation ΔTbk (KTbk-Tbk) obtained by subtracting the block-side outlet temperature Tbk from the reference block-side outlet temperature KTbk. More specifically, when the deviation ΔTbk takes a positive value, the valve opening Vo of the first flow regulating valve 22*b* is set to so small a valve opening as 10% or less; and when the deviation Tbk takes a negative value, the valve opening Vo of the first flow regulating valve 22*b* is increased with reduction in deviation ΔTbk. In FIG. 10, the control characteristic diagram in FIG. 13 is represented by a function of f7(KTbk,Tbk).

Figure 14:
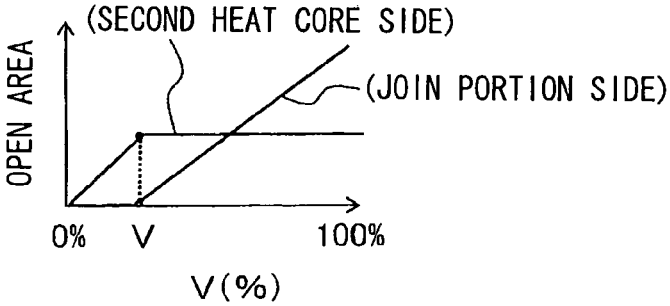
FIG. 14 is a graph indicating the relation between a second heater core-side open area, a join portion-side open area, and a valve opening of a first flow regulating valve in the fourth embodiment.

The open area of the passage for causing the cooling water to flow to the side of the second heater core 32 and the open area of the passage for causing the cooling water to flow to the side of the join portion 23 are changed based on the valve opening Vo of the first flow regulating valve 22*b*, as indicated by the graph in FIG. 14. Specifically, in the first flow regulating valve 22*b* of the present embodiment, within the range of 0%≥Vo≥V % (V is a predetermined value stored beforehand in the engine controller), only the open area of the passage for causing cooling water to flow to the second heater core 32 side is increased in accordance with increase in valve opening Vo; and within the range of V %≥Vo, only the open area of the passage for causing cooling water to flow to the join portion 23 side is increased in accordance with increase in valve opening Vo.

Therefore, when the first flow regulating valve 22*b* increases the valve opening Vo, cooling water flows in first into the second heater core 32, and then the cooling water flows into the join portion 23. Further, when the deviation ΔTbk takes a negative value, the valve opening Vo of the first flow regulating valve 22*b* is increased with reduction in deviation ΔThd; therefore, the first flow regulating valve 22*b* is so controlled that the detection value from the block-side thermistor 43 is brought close to the reference block-side outlet temperature KTbk.

In the main routine, the second flow amount control portion of the engine controller outputs control voltage to the second opening-closing valve 26*a*, so that the detection value from the suction-side thermistor 42 is brought close to the reference suction-side temperature KTsuc, as in the second embodiment.

The cooling water pumping capability control portion outputs control voltage to the electric motor for the water pump 21 so that the rotation speed (cooling water pumping capability) of the water pump 21 changes by the amount of change ΔNwp determined at Step S6. Further, the first flow amount control portion outputs a control signal to the first flow regulating valve 22*b* so that its valve opening becomes equal to the valve opening Vo determined at Step S7.

Since the engine cooling device 1 in the present embodiment operates as mentioned above, the same effect as in the second embodiment can be obtained. In addition, since the first flow regulating valve 22*b* is adopted as the first flow amount changing portion in the present embodiment, the block-side outlet temperature Tbk can be accurately adjusted by electrical control.

(Fifth Embodiment)

Figure 15:
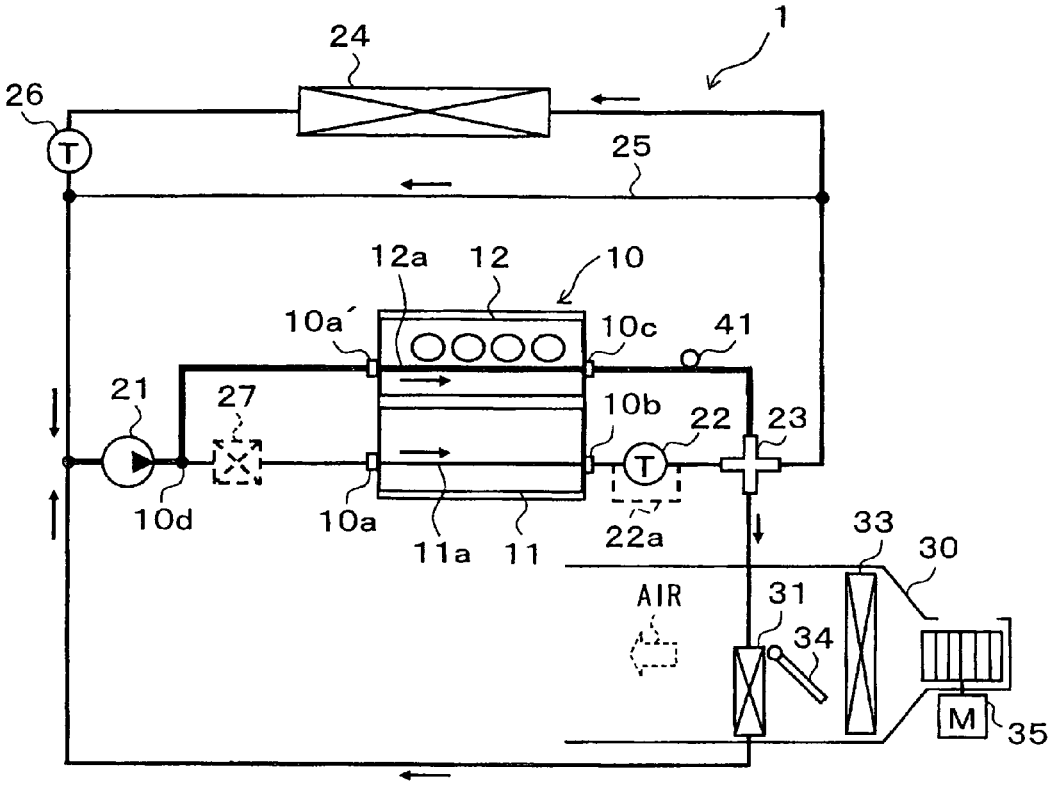
FIG. 15 is an overall schematic diagram of an engine cooling device in a fifth embodiment.

In a fifth embodiment, a case where the following measures are taken in the second embodiment as illustrated in the overall schematic diagram in FIG. 15 will be taken as an example: the second flow amount changing portion is changed to the second thermostat 26 constructed of the same mechanical mechanism as in the first embodiment; and the branch passage and the second heater core 32 are disused to simplify the configuration of the engine cooling device 1.

In the present embodiment, all the amount of cooling water flowing out of the first thermostat 22 is let to flow to one cooling water inflow port of the join portion 23.

Therefore, cooling water obtained by joining together cooling water flowing out of the head-side flow path 12*a* and cooling water flowing out of the first thermostat 22 flows into the heater core 31 through the join portion 23. The outlet side of the heater core 31 is connected to the suction side of the water pump 21. The other configuration elements are the same as those in the second embodiment.

Also with the configuration in the present embodiment, it is possible to independently control the head-side outlet temperature Thd and the block-side outlet temperature Tbk and to make the block-side outlet temperature Tbk higher than the head-side outlet temperature Thd. Therefore, drop in the temperature of air can be restricted through a simple configuration even when the temperature of cooling water circulated through the head-side flow path 12*a* is lowered.

(Sixth Embodiment)

Figure 16:
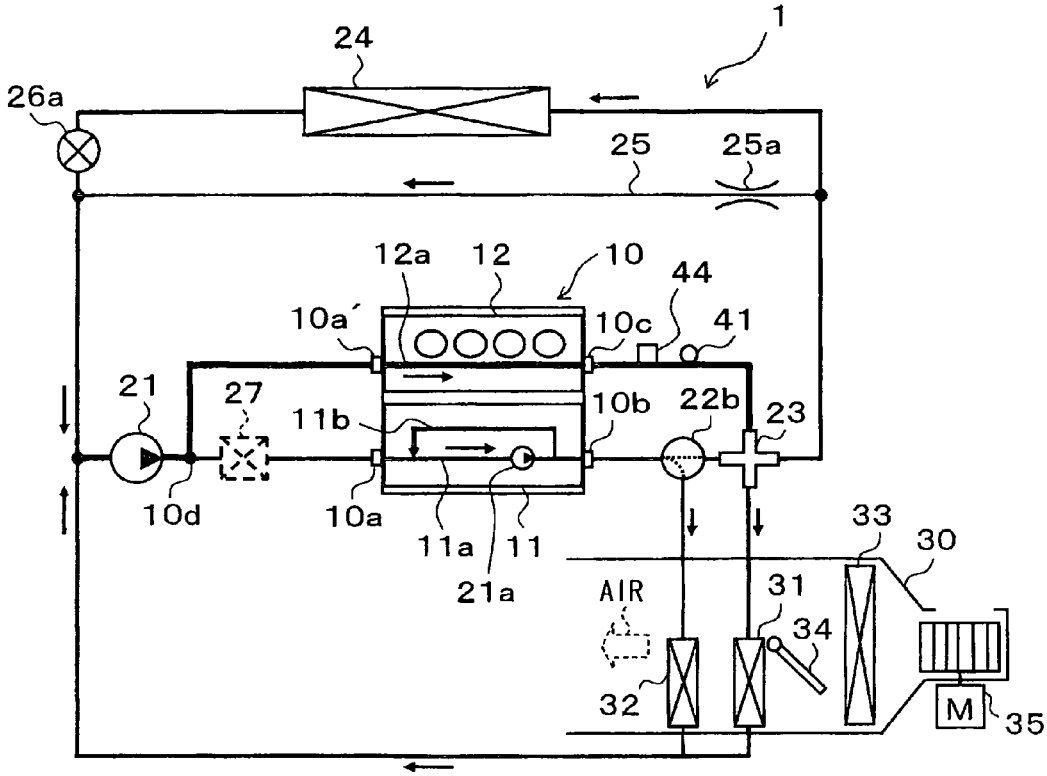
FIG. 16 is an overall schematic diagram of an engine cooling device in a sixth embodiment.

In a sixth embodiment, a case where the following measures are taken in the fourth embodiment as illustrated in the overall schematic diagram in FIG. 16 will be taken as an example: a second electric water pump 21*a* is disposed in the block-side flow path 11*a* in the cylinder block 11; and a circulation flow path 11*b* through which cooling water is circulated in the cylinder block 11 by the second electric water pump 21*a* is provided.

The basic configuration of the second electric water pump 21*a* is the same as that of the water pump 21. The cooling water pumping capability of the second electric water pump 21*a* is lower than the cooling water pumping capability of the water pump 21. That is, when identical control voltage is supplied, the flow amount of cooling water discharged from the second electric water pump 21*a* is lower than the flow amount of cooling water discharged from the water pump 21.

In the present embodiment, a head-side outlet pressure sensor 44 is disposed in the passage extended from the second outflow port 10*c* of the engine 10 to the other cooling water inflow port of the join portion 23. This head-side outlet pressure sensor 44 functions as a head-side outlet pressure detection portion that detects the pressure Phd of cooling water flowing out of the head-side flow path 12*a*. The head-side outlet pressure detection portion is connected to the input side of the engine controller. The other configuration elements are the same as those in the fourth embodiment.

Figure 17:
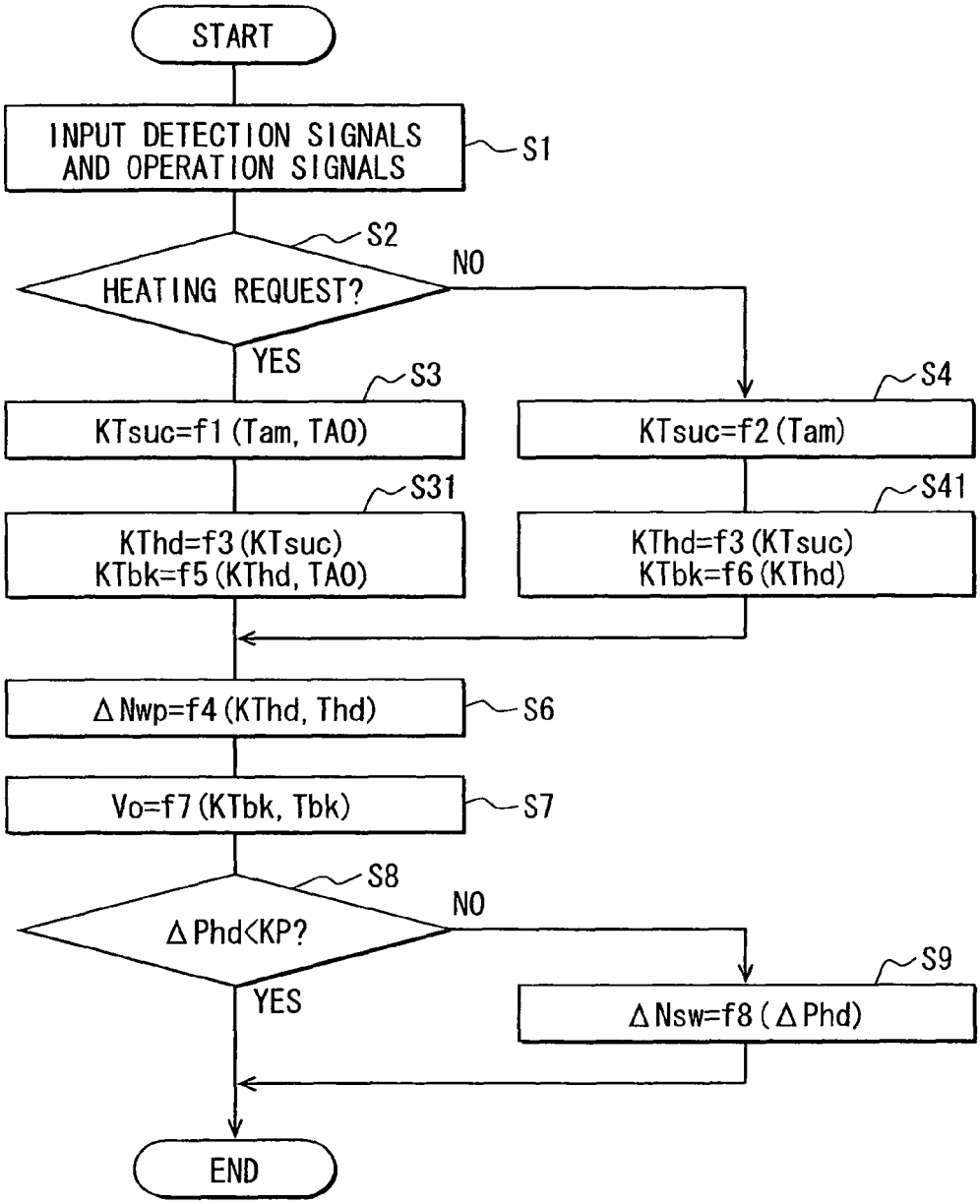
FIG. 17 is a flowchart illustrating control processing by an engine controller in the sixth embodiment.

Description will be given to the operation of the present embodiment. The basic operations of the engine 10 and the vehicle air conditioner are the same as those in the first embodiment. Description will be given to the operation of the engine cooling device 1 with reference to the flowchart in FIG. 17 and the control characteristic diagram in FIG. 18. The flowchart shown in FIG. 17 illustrates the processing carried out as a subroutine as in the fourth embodiment. Each control processing at Steps S1 to S4, S31, S41, S6, and S7 is completely the same as that in the second embodiment. In the present embodiment, the following processing is carried out at Step S8 subsequent to Step S7: it is determined whether or not the pressure difference ΔPhd(Phd-Phdn-1) obtained by subtracting previously read Phdn-1 from the cooling water pressure Phd read at Step S1 this time is smaller than a reference cooling water pressure KP.

When it is determined at Step S8 that the pressure difference ΔPhd(Phd-Phdn-1) is smaller than the reference cooling water pressure KP, the following processing is carried out: it is determined that the amount of change in the pressure of cooling water circulated through the block-side flow path 11*a*, circulation flow path 11*b*, or head-side flow path 12*a* is small and the flow returns to the main routine.

Meanwhile, when it is determined at Step S8 that the pressure difference ΔPhd(Phd-Phdn-1) is not smaller than the reference cooling water pressure KP, the following processing is carried out: it determined that bumping or the like has occurred in cooling water circulated through the block-side flow path 11*a*, circulation flow path 11*b*, or head-side flow path 12*a* and the pressure has largely changed and the control program proceeds to Step S9.

Figure 18:
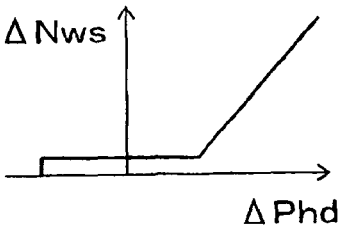
FIG. 18 is a control characteristic diagram indicating the relation between a head-side outlet pressure, a reference pressure difference, and the amount of change in the rotation speed of a second electric water pump in the sixth embodiment.

At Step S9, the amount of change ΔNws in the rotation speed (cooling water pumping capability) of the second electric water pump 21*a* is determined as indicated by the control characteristic diagram in FIG. 18. That is, the amount of change in control voltage outputted to the electric motor for the second electric water pump 21*a* is determined. Then the flow returns to the main routine. At Step S9, specifically, the amount of change ΔNws in the rotation speed of the second electric water pump 21*a* is determined so that it is increased with increase in pressure difference ΔPhd(Phd-Phdn-1). In FIG. 17, the control characteristic diagram in FIG. 18 is represented by a function of f8(ΔPhd).

In the main routine, the second flow amount control portion outputs control voltage to the second opening-closing valve 26*a* as in the fourth embodiment and the cooling water pumping capability control portion changes the rotation speed of the water pump 21. Further, the first flow amount control portion outputs a control signal to the first flow regulating valve 22*b* so that its valve opening becomes equal to the valve opening Vo determined at Step S7. In addition, the cooling water pumping capability control portion in the present embodiment outputs control voltage to the electric motor for the second electric water pump 21*a* so that the rotation speed thereof changes by the amount of change ΔNws determined at Step S9.

Since the engine cooling device 1 in the present embodiment operates as mentioned above, the same effect as in the fourth embodiment can be obtained. Further, the second electric water pump 21*a* circulates part of cooling water circulated through the block-side flow path 11*a* through the circulation flow path 11*b*, therefore, it is possible to quickly raise the block-side outlet temperature Tbk and swiftly accomplish heating in the vehicle compartment.

In addition, since the head-side outlet pressure sensor 44 is provided, the fluctuation in pressure due to bumping can be detected even when bumping or the like occurs in cooling water circulated through the block-side flow path 11*a*, the circulation flow path 11*b*, or the head-side flow path 12*a*.

When pressure fluctuation is detected by the head-side outlet pressure sensor 44, the cooling water pumping capability control portion enhances the cooling water pumping capability of the second electric water pump 21*a*. Therefore, it is possible to suppress rise in the temperature of cooling water circulated through the block-side flow path 11*a*. As a result, it is also possible to suppress unwanted temperature rise and pressure rise in cooling water circulated through the interior of the engine 10 so as to protect the engine 10.

(Seventh Embodiment)

Figure 19:
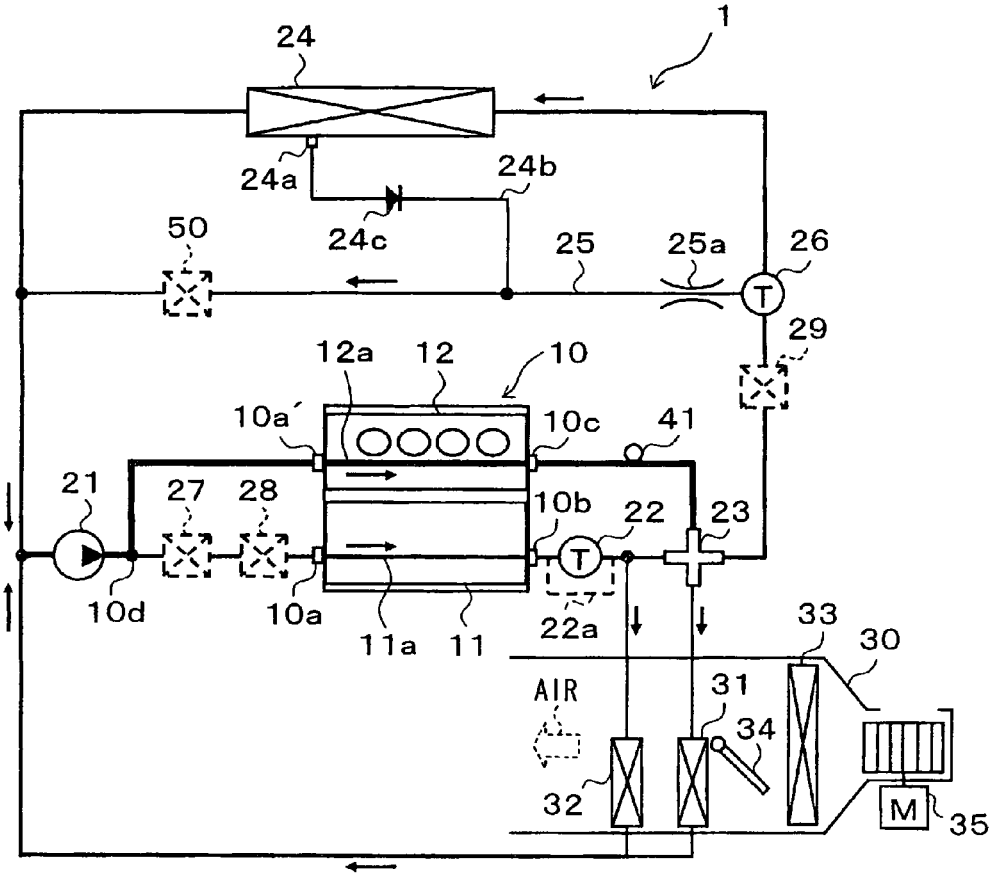
FIG. 19 is an overall schematic diagram of an engine cooling device in a seventh embodiment.

In a seventh embodiment, electric equipments, such as an electric motor for running and an inverter for the motor for vehicle running, (hereafter, collectively referred to HV equipment), can be cooled by the engine cooling device 1, in addition to the intake air and exhaust gas of the engine 10, as shown in FIG. 19.

Specifically, the second thermostat 26 in the present embodiment is disposed at the joint with the bypass passage 25 in the cooling water passage extended from the other cooling water outflow port of the join portion 23 to the cooling water inlet port of the radiator 24.

The second thermostat 26 functions as described below on a case-by-case basis. The temperature of cooling water flowing out of the other cooling water outflow part of the join portion 23 and flowing into the radiator becomes equal to or higher than a predetermined reference temperature (65° C. in the present embodiment as in the first embodiment). In this case, the second thermostat 26 lets cooling water flowing out of the other cooling water outflow port of the join portion 23 flow to the radiator 24 side. When the temperature of the cooling water becomes lower than the temperature, the second thermostat 26 lets it flow to the bypass passage 25 side.

In the bypass passage 25 in the present embodiment, there is disposed the same fixed throttle 25*a* as in the third embodiment. At some midpoint in the cooling water passage of the radiator 24 in the present embodiment, there is provided a flow dividing port 24*a* through which a part of cooling water in process of cooling circulated through the interior of the radiator 24 to flow out of the radiator 24. Therefore, the temperature of cooling water flowing out of the cooling water outlet of the radiator 24 is lower than the temperature of cooling water flowing out of the flow dividing port 24*a*.

This flow dividing port 24*a* is connected to the downstream side of the fixed throttle 25*a* in the direction of cooling water flow in the bypass passage 25 through a flow dividing passage 24*b*. In the flow dividing passage 24*b*, there is provided a check valve 24*c* that permits cooling water to flow only from the flow dividing port 24*a* side of the radiator 24 to the bypass passage 25 side. Therefore, even when the second thermostat 26 causes the cooling water to flow to the bypass passage 25, the cooling water that flowed into the bypass passage 25 does not flow backward from the side of the bypass passage 25 to the side of the radiator 24.

On the downstream side of the joint with the flow dividing passage 24*b* in the cooling water flow in the bypass passage 25, there is disposed an HV cooler that causes cooling water to absorb waste heat from the HV equipment. Specifically, the EV cooler is constructed of a cooling water flow path and the like formed in electrical apparatuses, such as the electric motor for running and the inverter for the motor for vehicle running and is configured integrally with the HV equipment.

In the present embodiment, further, the EGR cooler 27, the exhaust manifold cooler 28, and the intercooler 29 are disposed as in the second embodiment. The other configuration elements are the same as those in the second embodiment.

Also with the configuration in the present embodiment, therefore, it is possible to independently control the head-side outlet temperature Thd and the block-side outlet temperature Tbk and make the block-side outlet temperature Tbk higher than the head-side outlet temperature Thd. Therefore, it is possible to suppress drop in the temperature of air even though the temperature of cooling water circulated through the head-side flow path 12*a* is lowered.

Further, the present embodiment is provided with the EGR cooler 27, exhaust manifold cooler 28, intercooler 29, and HV cooler. Therefore, it is possible to cool the HV equipment as well as exhaust gas returned to the intake air side, exhaust gas circulated through the exhaust manifold, and intake air supercharged into each combustion chamber as in the second embodiment.

In the present embodiment, at this time, part of cooling water in process of cooling at the radiator 24 is used to cool the HV equipment. Therefore, the temperature of cooling water for cooling the HV equipment can be cooled according to the position of the flow dividing port 24*a* in the radiator 24. In the engine cooling device 1 in the present embodiment, therefore, multi-system cooling can be achieved and the intake air and exhaust gas of the engine 10 and the HV equipment are cooled by cooling water at temperatures suitable for cooling them.

(Eighth Embodiment)

Figure 20:
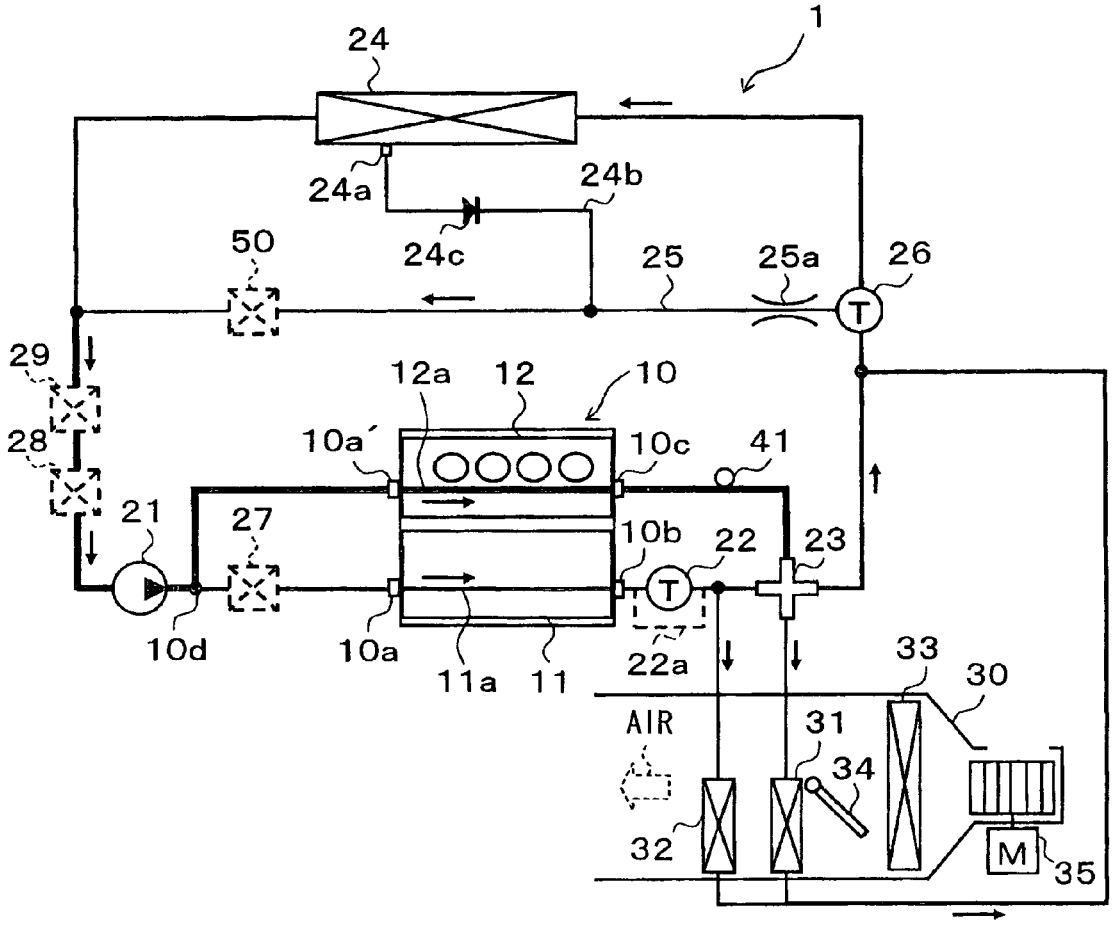
FIG. 20 is an overall schematic diagram of an engine cooling device in an eighth embodiment.

An embodiment is obtained by taking the following measure in the seventh embodiment as illustrated in the overall schematic diagram in FIG. 20: the mode of connection of the first and second heater cores 31, 32 on the cooling water outlet side is changed; and the arrangement of the exhaust manifold cooler 28 and the intercooler 29 is changed.

More specific description will be given. In the present embodiment, the cooling water outlets of the first and second heater cores 31, 32 are connected to the upstream side of the second thermostat 26 in terms of cooling water flow on the inlet side of the radiator 24; and the exhaust manifold cooler 28 and the intercooler 29 are arranged between the outlet of the bypass passage 25 and the suction side of the water pump 21. Also with the configuration in the present embodiment, the same effect as in the seventh embodiment can be obtained.

A configuration in which the cooling water outlets of the first and second heater cores 31, 32 are connected to the inlet side of the radiator 24 as in the present embodiment can also be applied to the first to sixth embodiments.

(Other Embodiments)

The invention is not limited to the above-described embodiments and can be variously modified without departing from the subject matter thereof as described below.

(1) In the description of the above embodiments, cases where an electric water pump 21 is adopted as the cooling water pressure-feed unit have been taken as examples. Needless to add, a mechanical water pump in which driving force is obtained form the crankshaft of an engine 10 or the like may be adopted. In this case, by coupling together the crankshaft and the rotating shaft of the water pump through an electromagnetic clutch, the cooling water pumping capability of the water pump can be changed by a cooling water pumping capability control portion controlling turn-on/off of the electromagnetic clutch.

(2) In the description of the above embodiments, cases where the first thermostat 22 or the three-way first flow regulating valve 22*b* is adopted as the first flow amount changing portion have been taken as examples. Instead, a first opening-closing valve whose configuration is identical with that of the second flow amount changing portion (second opening-closing valve) or an electric first flow regulating valve (first linear valve) capable of continuously changing the area of the cooling water passage may be adopted.

More specifically, a first opening-closing valve or a linear valve can be disposed in the cooling water passage that guides cooling water flowing out of the block-side flow path 11*a* to the first and second heater cores 31, 32. Then the first flow amount control portion controls the operation of the first opening-closing valve or the first linear valve so that the detection value from the block-side thermistor 43 including the block-side outlet temperature detection portion is brought close to the reference block-side outlet temperature KTbk.

At this time, the first flow amount control portion may be provided with a function of determining to raise the reference block-side outlet temperature KTbk with drop in outside air temperature Tam. This makes it possible to raise the block-side outlet temperature Tbk of cooling water, that is, the temperature of cooling water used as a heat source for heating air with drop in outside air temperature Tam. Therefore, drop in the temperature of air can be effectively restricted.

When heating is requested by an occupant, the first flow amount control portion may determine the reference block-side outlet temperature KTbk to a value lower than when heating is not requested. This makes it possible to increase the flow amount for heat source when heating is selected and thus heating can be swiftly accomplished in accordance with a user's request.

(3) In the description, of the first to fourth and sixth to eighth embodiments, cooling water obtained by joining together cooling water flowing out of the head-side flow path 12*a* and part of cooling water flowing out of the first flow amount changing portion 22 is let to flow into the first heater core 31, and cooling water flowing out of the first flow amount changing portion 22 is let to flow into the second heater core 32. However, the cooling water let to flow into the first and second heater cores 31, 32 is not limited to this.

For example, only cooling water flowing out of the head-side flow path 12*a* may be set to flow into the first heater core 31, or/and only cooling water flowing out of the block-side flow path 11*a* may be set to flow into the second heater core 32 through the first flow amount changing portion 22. Even when cooling water is let to flow as mentioned above, the temperature of cooling water circulated through the first heater core 31 is lower than the temperature of cooling water circulated through the second heater core 32. This makes it possible to ensure a temperature difference between the first heater core 31 and air and a temperature difference between the second heater core 32 and air to efficiently heat the air.

(4) The configurations described above in relation to the individual embodiments can be combined to the extent that it is practicable, for example, as described in relation to the eighth embodiment.

Such changes and modifications are to be understood as being within the scope of the present invention as defined by the appended claims.

What is claimed is:

1. An engine cooling device for cooling an internal combustion engine by circulating cooling water, and in which at least a part of cooling water flowing out of the internal combustion engine is used as a heat source for heating a fluid to be heated, wherein in the internal combustion engine, a block-side flow path and a head-side flow path are provided, the block-side flow path being for circulating cooling water for cooling a cylinder block and the head-side flow path being for circulating cooling water for cooling a cylinder head, the engine cooling device comprising:

a cooling water pressure-feed unit disposed to pressure-feed cooling water to the block-side flow path and the head-side flow path;

a first flow amount changing portion configured to change a flow amount of at least cooling water used as a heat source for heating the fluid, in the cooling water flowing out of the block-side flow path;

a heat-radiation heat exchanger disposed to radiate heat from cooling water flowing out of the head-side flow path and cooling water flowing out of the block-side flow path to the outside air and for causing the cooling water to flow out to a suction side of the cooling water pressure-feed unit;

a bypass passage provided to guide cooling water flowing out of the head-side flow path and cooling water flowing out of the block-side flow path to the suction side of the cooling water pressure-feed unit while bypassing the heat radiation heat exchanger;

a second flow amount changing portion configured to change a bypass flow amount of cooling water flowing through the bypass passage, a first heating heat exchanger disposed to heat the fluid, the first heating heat exchanger being coupled to the head-side flow path such that cooling water flowing out of the head-side flow path flows into the first heating heat exchanger; and a second heating heat exchanger disposed at a downstream side of the first heating heat exchanger in a flow direction of the fluid to heat the fluid, the second heating heat exchanger being coupled to the first flow amount changing portion such that cooling water flowing out of the block-side flow path flows into the second heating heat exchanger, wherein the second flow amount changing portion changes the bypass flow amount so that a suction-side temperature of cooling water on the suction side of the cooling water pressure-feed unit approaches a reference suction-side temperature, the first flow amount changing portion changes the flow amount of cooling water for the heat source so that a block-side outlet temperature of cooling water flowing out of the block-side flow path approaches a reference block-side outlet temperature, the reference block-side outlet temperature has a value higher than the reference suction-side temperature, and cooling water outlets of the first and second heating heat exchangers are connected to one of a suction side of the cooling water pressure-feed unit and an inlet side of the heat radiation heat exchanger.

2. The engine cooling device of claim 1, wherein the first flow amount changing portion includes an electric first opening-closing valve that opens and closes a passage for cooling water used as the heat source, the engine cooling device further comprising:

a first flow amount control portion configured to control operation of the first opening-closing valve; and a block-side outlet temperature detection portion configured to detect the block-side outlet temperature, wherein the first flow amount control portion controls operation of the first opening-closing valve so that the detection value of the block-side outlet temperature detection portion approaches the reference block-side outlet temperature.

3. The engine cooling device of claim 2, wherein the first flow amount control portion is configured to increase the reference block-side outlet temperature in accordance with a decrease of an outside air temperature.

4. The engine cooling device of claim 2, further comprising:

a heating selection portion for a user to select whether to heat the fluid by using the cooling water, wherein the first flow amount control portion has means for setting the reference block-side outlet temperature, and when the user selects to heat the fluid by using the heating selection portion, the setting means sets the reference block-side outlet temperature to a value lower than that when the user selects not to heat the fluid by using the heating selection portion.

5. The engine cooling device of claim 1, wherein the first flow amount changing portion includes an electric first flow regulating valve that adjusts the flow amount of cooling water for heat source by varying a valve opening, the engine cooling device further comprising:

a first flow amount control portion configured to control operation of the first flow regulating valve; and a block-side outlet temperature detection portion configured to detect the block-side outlet temperature, wherein the first flow amount control portion controls the operation of the first flow regulating valve so that a detection value of the block-side outlet temperature detection portion approaches the reference block-side outlet temperature.

6. The engine cooling device of claim 1, wherein the cooling water pressure-feed unit is an electric water pump.

7. The engine cooling device of claim 6, further comprising:

a cooling water pumping-capability control portion configured to control a cooling water pumping capability of the cooling water pressure-feed unit; and a head-side outlet temperature detection portion configured to detect the head-side outlet temperature, wherein the cooling water pumping-capability control portion controls operation of the cooling water pressure-feed unit so that the detection value of the head-side outlet temperature detection portion approaches the reference head-side outlet temperature.

8. The engine cooling device of claim 1, wherein a cooling water pumping capability of the cooling water pressure-feed unit is so controlled that a head-side outlet temperature of cooling water flowing out of the head-side flow path approaches a reference head-side outlet temperature.

9. The engine cooling device of claim 1, wherein the cooling water flowing out of the block-side flow path flows directly into the first flow amount changing portion and the fluid flow from the first flow amount changing portion flow directly to the second heating heat exchanger.

10. An engine cooling device for cooling an internal combustion engine by circulating cooling water, and in which at least a part of cooling water flowing out of the internal combustion engine is used as a heat source for heating a fluid to be heated, wherein in the internal combustion engine, a block-side flow path and a head-side flow path are provided, the block-side flow path being for circulating cooling water for cooling a cylinder block and the head-side flow path being for circulating cooling water for cooling a cylinder head, the engine cooling device comprising:

a cooling water pressure-feed unit disposed to pressure-feed cooling water to the block-side flow path and the head-side flow path;

a first flow amount changing portion configured to change a flow amount of at least cooling water used as a heat source for heating the fluid, in the cooling water flowing out of the block-side flow path;

a heat-radiation heat exchanger disposed to radiate heat from cooling water flowing out of the head-side flow path and cooling water flowing out of the block-side flow path to the outside air and for causing the cooling water to flow out to a suction side of the cooling water pressure-feed unit;

a bypass passage provided to guide cooling water flowing out of the head-side flow path and cooling water flowing out of the block-side flow path to the suction side of the cooling water pressure-feed unit while bypassing the heat radiation heat exchanger;

a second flow amount changing portion configured to change a bypass flow amount of cooling water flowing through the bypass passage;

a first heating heat exchanger disposed to heat the fluid, the first heating heat exchanger being coupled to the head-side flow path and the first flow amount changing portion such that cooling water obtained by joining together cooling water flowing out of the head-side flow path and a part of cooling water flowing out of the block-side flow path flows into the first heating heat exchanger; and a second heating heat exchanger disposed at a downstream side of the first heating heat exchanger in a flow direction of the fluid to heat the fluid, the second heating heat exchanger being coupled to the first flow amount changing portion such that another part of cooling water flowing out of the block-side flow path flows into the second heating heat exchanger, wherein the second flow amount changing portion changes the bypass flow amount so that a suction-side temperature of cooling water on the suction side of the cooling water pressure-feed unit approaches a reference suction-side temperature, a cooling water pumping capability of the cooling water pressure-feed unit is so controlled that a head-side outlet temperature of cooling water flowing out of the head-side flow path approaches a reference head-side outlet temperature, the first flow amount changing portion changes the flow amount of cooling water for the heat source so that a block-side outlet temperature of cooling water flowing out of the block-side flow path approaches a reference block-side outlet temperature, the reference block-side outlet temperature has a value higher than the reference suction-side temperature, and cooling water outlets of the first and second heating heat exchangers are connected to one of a suction side of the cooling water pressure-feed unit and an inlet side of the heat radiation heat exchanger.

11. The engine cooling device of claim 10, wherein the first flow amount changing portion includes an electric first opening-closing valve that opens and closes a passage for cooling water used as the heat source, the engine cooling device further comprising:

a first flow amount control portion configured to control operation of the first opening-closing valve; and a block-side outlet temperature detection portion configured to detect the block-side outlet temperature, wherein the first flow amount control portion controls operation of the first opening-closing valve so that the detection value of the block-side outlet temperature detection portion approaches the reference block-side outlet temperature.

12. The engine cooling device of claim 11, wherein the first flow amount control portion is configured to increase the reference block-side outlet temperature in accordance with a decrease of an outside air temperature.

13. The engine cooling device of claim 11, further comprising:

a heating selection portion for a user to select whether to heat the fluid by using the cooling water, wherein the first flow amount control portion has means for setting the reference block-side outlet temperature, and when the user selects to heat the fluid by using the heating selection portion, the setting means sets the reference block-side outlet temperature to a value lower than that when the user selects not to heat the fluid by using the heating selection portion.

14. The engine cooling device of claim 10, wherein the first flow amount changing portion includes an electric first flow regulating valve that adjusts the flow amount of cooling water for heat source by varying a valve opening, the engine cooling device further comprising:

a first flow amount control portion configured to control operation of the first flow regulating valve; and a block-side outlet temperature detection portion configured to detect the block-side outlet temperature, wherein the first flow amount control portion controls the operation of the first flow regulating valve so that a detection value of the block-side outlet temperature detection portion approaches the reference block-side outlet temperature.

15. The engine cooling device of claim 10, wherein the cooling water pressure-feed unit is an electric water pump.

16. The engine cooling device of claim 15, further comprising:

a cooling water pumping-capability control portion configured to control a cooling water pumping capability of the cooling water pressure-feed unit; and a head-side outlet temperature detection portion configured to detect the head-side outlet temperature, wherein the cooling water pumping-capability control portion controls operation of the cooling water pressure-feed unit so that the detection value of the head-side outlet temperature detection portion approaches the reference head-side outlet temperature.

17. The engine cooling device of claim 10, wherein a cooling water pumping capability of the cooling water pressure-feed unit is so controlled that a head-side outlet temperature of cooling water flowing out of the head-side flow path approaches a reference head-side outlet temperature.

18. The engine cooling device of claim 10, wherein the cooling water flowing out of the block-side flow path flows directly into the first flow amount changing portion and the fluid flow from the first flow amount changing portion flow directly to the second heating heat exchanger.

* * * * *